US011565902B2

(12) United States Patent
Hirai et al.

(10) Patent No.: US 11,565,902 B2
(45) Date of Patent: Jan. 31, 2023

(54) MEDIUM REVERSING AND DISCHARGING DEVICE

(71) Applicant: PFU Limited, Ishikawa (JP)

(72) Inventors: Yoshito Hirai, Ishikawa (JP); Ryoichi Yasukawa, Ishikawa (JP)

(73) Assignee: PFU LIMITED, Ishikawa (JP)

( * ) Notice: Subject to any disclaimer, the term of this patent is extended or adjusted under 35 U.S.C. 154(b) by 3 days.

(21) Appl. No.: 17/183,150

(22) Filed: Feb. 23, 2021

(65) Prior Publication Data

US 2021/0171308 A1 Jun. 10, 2021

Related U.S. Application Data

(63) Continuation of application No. PCT/JP2018/034821, filed on Sep. 20, 2018.

(51) Int. Cl.

| | |
|---|---|
| ***B65H 15/00*** | (2006.01) |
| ***B65H 29/24*** | (2006.01) |
| ***B65H 29/40*** | (2006.01) |

(52) U.S. Cl.

CPC ..... *B65H 15/00* (2013.01); *B65H 29/245* (2013.01); *B65H 29/40* (2013.01); *B65H 2801/06* (2013.01)

(58) Field of Classification Search

CPC ..... B65H 15/00; B65H 29/245; B65H 29/40; B65H 2801/06; B65H 2301/44765

See application file for complete search history.

(56) References Cited

U.S. PATENT DOCUMENTS

| | | | | |
|---|---|---|---|---|
| 4,770,405 | A * | 9/1988 | Fukushima | B65H 29/40 271/187 |
| 5,026,036 | A * | 6/1991 | Takahashi | B65H 29/40 271/291 |
| 5,090,680 | A * | 2/1992 | Yashiro | B41J 3/60 271/186 |
| 5,114,135 | A | 5/1992 | Evangelista et al. | |
| 10,005,632 | B1 * | 6/2018 | Ruiz | B65H 43/00 |

(Continued)

FOREIGN PATENT DOCUMENTS

| | | |
|---|---|---|
| JP | H02-031281 U | 2/1990 |
| JP | H04-032457 A | 2/1992 |

(Continued)

OTHER PUBLICATIONS

International Search Report issued in corresponding International Patent Application No. PCT/JP2018/034821, dated Nov. 6, 2018, with English translation.

*Primary Examiner* — Thomas A Morrison

(74) *Attorney, Agent, or Firm* — McDermott Will & Emery LLP

(57) ABSTRACT

A medium reversing and discharging device includes a discharger that discharges a medium in a paper discharge direction from a discharge outlet, a holder that holds and reverses the medium, and a driver that moves the holder such that when a first plane along a portion of the medium in contact with the discharge outlet does not intersect with a second plane along a portion of the medium held by the holder on a downstream side in the paper discharge direction of the discharge outlet a moving speed at which the holder moves is lower than a discharge speed at which the medium is discharged from the discharge outlet.

10 Claims, 29 Drawing Sheets

(56) References Cited

U.S. PATENT DOCUMENTS

| | | | | |
|---|---|---|---|---|
| 2005/0271448 | A1* | 12/2005 | Shmaiser ..... | B65H 9/004<br>400/624 |
| 2010/0109228 | A1 | 5/2010 | Obara et al. | |
| 2011/0187038 | A1 | 8/2011 | Heise et al. | |
| 2013/0001872 | A1 | 1/2013 | Heise et al. | |

FOREIGN PATENT DOCUMENTS

| | | | |
|---|---|---|---|
| JP | H05-70018 | A | 3/1993 |
| JP | 2009-504531 | A | 2/2009 |
| JP | 2010-105802 | A | 5/2010 |
| WO | 2007/017182 | A1 | 2/2007 |

* cited by examiner

MEDIUM REVERSING AND DISCHARGING DEVICE

CROSS-REFERENCE TO RELATED APPLICATION

This application is a continuation of International Application No. PCT/JP2018/034821, filed on Sep. 20, 2018, the entire contents of which are incorporated herein by reference.

FIELD

The embodiments discussed herein are related to a medium reversing and discharging device.

BACKGROUND

Medium reversing and discharging devices are known that, when discharging a plurality of media from a printing press, a printer device, or a scanner device, reverse the media in the air to stack the media on an exit tray so as to be aligned at leading ends thereof (Japanese Laid-open Patent Publication No. 2010-105802, Japanese Translation of PCT International Application Publication No. 2009-504531, and Japanese Laid-open Patent Publication No. 4-32457).

However, a sheet of paper read by the scanner may have a tendency such as a folding tendency, and may buckle when being reversed, resulting in a discharge failure.

SUMMARY

According to an aspect of an embodiment, a medium reversing and discharging device includes a discharger that discharges a medium in a paper discharge direction from a discharge outlet, a holder that holds and reverses the medium, and a driver that moves the holder such that when a first plane along a portion of the medium in contact with the discharge outlet does not intersect with a second plane along a portion of the medium held by the holder on a downstream side in the paper discharge direction of the discharge outlet, a moving speed at which the holder moves is lower than a discharge speed at which the medium is discharged from the discharge outlet.

The object and advantages of the disclosure will be realized and attained by means of the elements and combinations particularly pointed out in the claims.

It is to be understood that both the foregoing general description and the following detailed description are exemplary and explanatory and are not restrictive of the disclosure.

DESCRIPTION OF EMBODIMENTS

Figure 1:
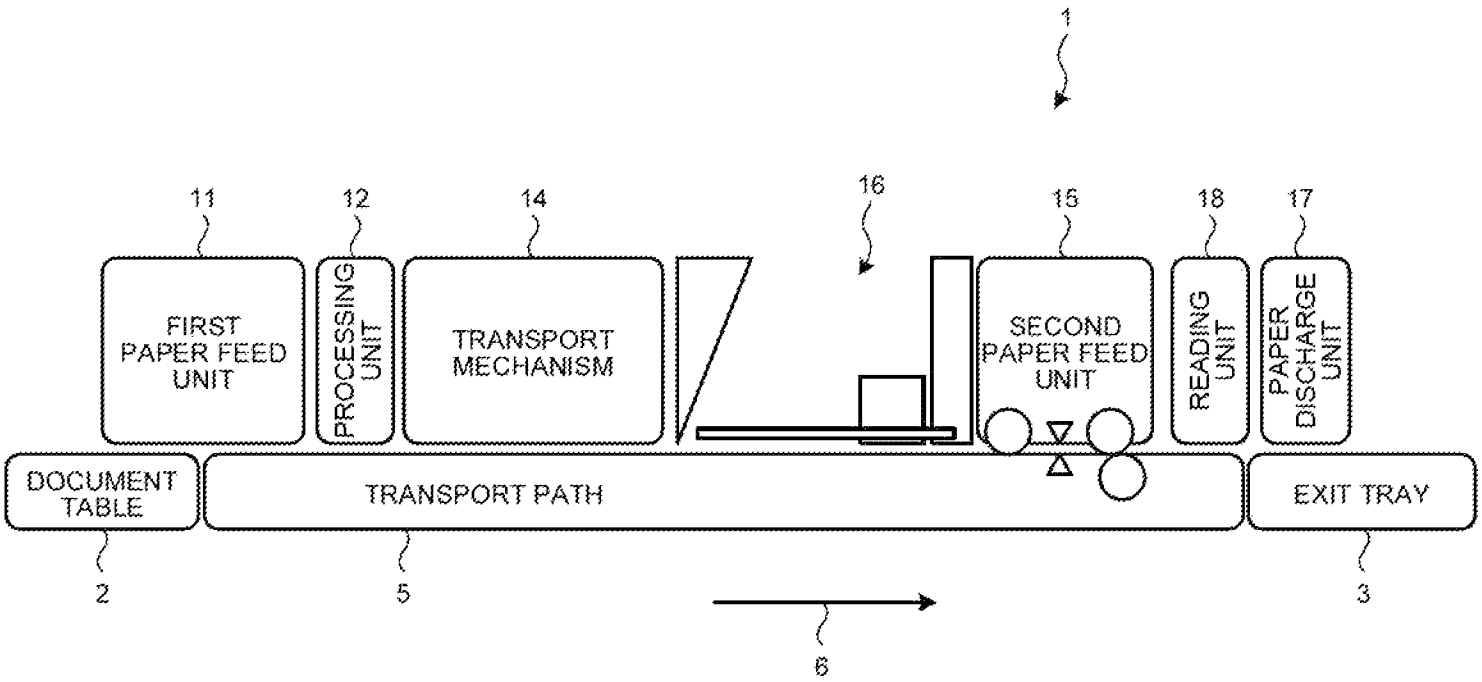
FIG. 1 is a schematic side view illustrating an image reading device provided with a medium reversing and discharging device according to a first embodiment of the present disclosure.

Preferred embodiments of the disclosure will be explained with reference to accompanying drawings. The following describes a medium reversing and discharging device according to embodiments disclosed by the present application. The present disclosure is not limited to the following description. In the following description, the same components are denoted by the same reference numerals, and are not repeatedly described.

First Embodiment

As illustrated in FIG. 1, a medium reversing and discharging device according to a first embodiment of the present disclosure is used in an image reading device 1. FIG. 1 is a schematic side view illustrating the image reading device 1 provided with the medium reversing and discharging device according to the first embodiment. The image reading device 1 includes a document table 2, an exit tray 3, and a transport path 5. A medium is placed on the document table 2. The exit tray 3 is disposed on a downstream side in a transport direction 6 of the document table 2. The transport direction 6 is substantially parallel to a plane along an installation surface on which the image reading device 1 is installed. The transport path 5 is disposed between the document table 2 and the exit tray 3, and forms a path connecting the document table 2 to the exit tray 3. The transport path 5 guides the medium fed to the transport path 5 so as to transport the medium fed to the transport path 5 along the path toward the downstream side in the transport direction 6.

The image reading device 1 further includes a first paper feed unit 11, a processing unit 12, a transport mechanism 14, a second paper feed unit 15, an unfolding unit 16, a paper discharge unit 17, and a reading unit 18. The first paper feed unit 11 is disposed at an end on the document table 2 side of the transport path 5. The first paper feed unit 11 detects whether the medium is placed on the document table 2. When a plurality of the media are placed on the document table 2, the first paper feed unit 11 feeds one medium disposed on the uppermost side of the media placed on the document table 2 to the transport path 5 to supply the medium to the processing unit 12. When one medium is placed on the document table 2, the first paper feed unit 11 feeds the medium to the transport path 5 to supply the medium to the processing unit 12.

The processing unit 12 is disposed on the downstream side of the first paper feed unit 11 on the transport path 5, that is, disposed between the first paper feed unit 11 and the exit tray 3 on the transport path 5. The processing unit 12 detects whether the medium supplied from the first paper feed unit 11 is a single-sheet medium or a bound medium. The single-sheet medium is formed of one sheet of paper. The bound medium is formed by binding a plurality of sheets of paper using a binding member or members. Examples of the binding member include a staple.

When the processing unit 12 has detected that the medium supplied from the first paper feed unit 11 is the single-sheet medium, the processing unit 12 supplies the single-sheet medium as it is to the transport mechanism 14. When the processing unit 12 has detected that the medium supplied from the first paper feed unit 11 is the bound medium, the processing unit 12 removes the binding member or members from the bound medium to generate a plurality of single-sheet media, and supplies each of the generated single-sheet media to the transport mechanism 14.

The transport mechanism 14 is disposed in an area on the downstream side of the processing unit 12 on the transport path 5, that is, disposed between the processing unit 12 and the exit tray 3 on the transport path 5. The transport mechanism 14 supplies the medium supplied from the processing unit 12 to the second paper feed unit 15.

The second paper feed unit 15 is disposed on the downstream side of the transport mechanism 14 on the transport path 5, that is, disposed between the transport mechanism 14 and the exit tray 3 on the transport path 5. The second paper feed unit 15 supplies the medium supplied from the transport mechanism 14 to the paper discharge unit 17.

The unfolding unit 16 is disposed between the transport mechanism 14 and the second paper feed unit 15 on the transport path 5. When the medium transported between the transport mechanism 14 and the second paper feed unit 15 is a Z-folded medium, the unfolding unit 16 unfolds the Z-folded medium so as to be substantially flat.

The paper discharge unit 17 is disposed at an end on the exit tray 3 side of the transport path 5, that is, disposed on the downstream side of the second paper feed unit 15 on the transport path 5. The paper discharge unit 17 reverses the medium supplied from the second paper feed unit 15, and places the reversed medium on the exit tray 3.

The reading unit 18 is disposed between the second paper feed unit 15 and the paper discharge unit 17 on the transport path 5. The reading unit 18 reads images on both surfaces of the medium transported between the second paper feed unit 15 and the paper discharge unit 17 on the transport path 5.

Figure 2:
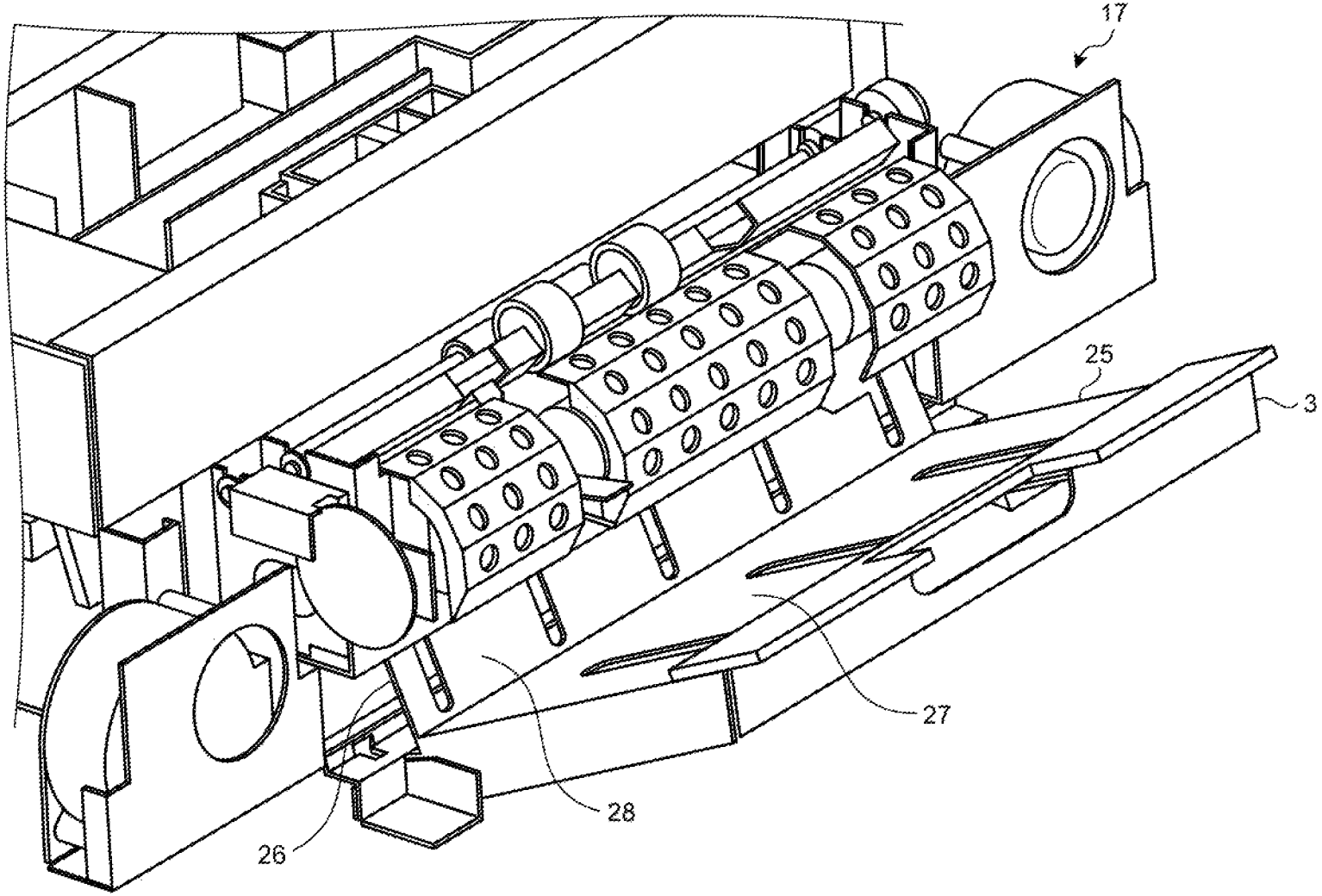
FIG. 2 is a perspective view illustrating an exit tray of the medium reversing and discharging device according to the first embodiment.

FIG. 2 is a perspective view illustrating the exit tray 3 of the medium reversing and discharging device according to the first embodiment. The exit tray 3 includes an exit tray body 25 and a stopper 26. The exit tray body 25 has a substantially flat placement surface 27. The exit tray body 25 is fixed to the transport path 5 in an inclined state such that gravity causes the medium placed on the placement surface 27 to slide down toward an upstream side in the transport direction 6. The stopper 26 has a plate shape, and has a substantially flat stopper surface 28. The stopper 26 is disposed on the upstream side in the transport direction 6 of the exit tray body 25 such that the stopper surface 28 faces the downstream side in the transport direction 6 and such that a plane along the stopper surface 28 is orthogonal to a plane along the placement surface 27, and is fixed to the exit tray body 25.

Figure 3:
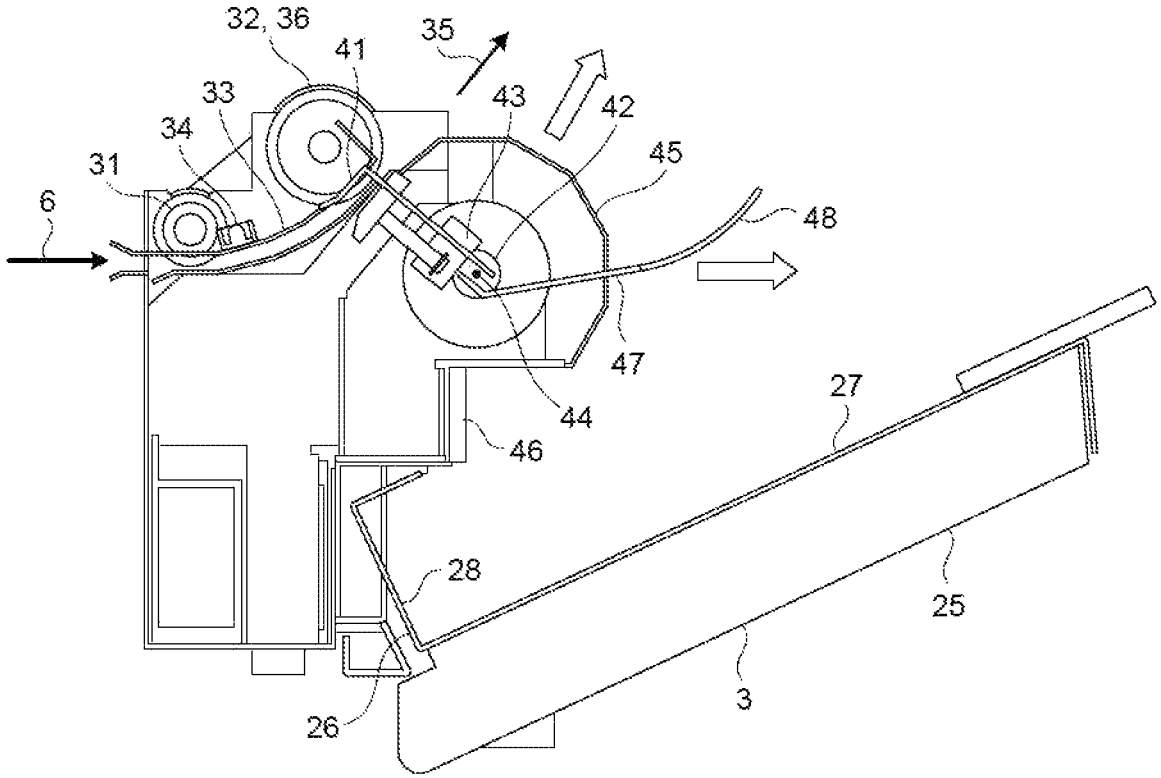
FIG. 3 is a sectional view illustrating a paper discharge unit of the medium reversing and discharging device according to the first embodiment.

The exit tray 3 is disposed below the paper discharge unit 17. FIG. 3 is a sectional view illustrating the paper discharge unit 17 of the medium reversing and discharging device according to the first embodiment. The paper discharge unit 17 includes a transport roller pair 31, a discharger 32, a curved portion 33, and a position detection sensor 34. The rollers of the transport roller pair 31 are close to each other so as to pinch the medium supplied from the second paper feed unit 15 to the paper discharge unit 17. When the medium is pinched by the transport roller pair 31, the transport roller pair 31 rotates to supply the medium to the discharger 32. The discharger 32 includes a discharge roller pair 36. The rollers of the discharge roller pair 36 are close to each other so as to pinch the medium supplied from the transport roller pair 31. When the medium is pinched by the discharge roller pair 36, the discharge roller pair 36 rotates to discharge the medium in a paper discharge direction 35. The paper discharge direction 35 is inclined obliquely upward with respect to the transport direction 6.

The curved portion 33 is disposed between the transport roller pair 31 and the discharger 32, and forms a path connecting the transport roller pair 31 to the discharger 32. The position detection sensor 34 is disposed between the transport roller pair 31 and the discharger 32, and detects whether the medium is disposed in a predetermined position of the curved portion 33 between the transport roller pair 31 and the discharger 32.

The paper discharge unit 17 further includes a holder 41, a driver 42, and a cam mechanism 43. The holder 41 is switched to a holding mode or a releasing mode. The holder 41 holds the medium by being switched from the releasing mode to the holding mode, and releases the medium by being switched from the holding mode to the releasing mode. Further, the holder 41 is supported by the transport path 5 so as to be rotatable about a rotation axis 44. The rotation axis 44 is parallel to a plane along the installation surface of the image reading device 1, and is orthogonal to the transport direction 6. The paper discharge direction 35 is orthogonal to the rotation axis 44.

The driver 42 rotates the holder 41 (clockwise in FIG. 3) about the rotation axis 44 to dispose the holder 41 in an initial position, a holding position, a standby position, and a hold releasing position. The holder 41 is disposed near the discharger 32 when being disposed in the initial position, is disposed on the downstream side in the paper discharge direction 35 of the discharger 32 when being disposed in the holding position, is disposed on the downstream side in the paper discharge direction 35 of a stopper 46 when being disposed in the standby position, and is disposed near the stopper 46 when being disposed in the hold releasing position.

The cam mechanism 43 includes a groove fixed to the transport path 5 and a cam fitted in the groove. When the holder 41 rotates, the cam moves while being guided through the groove, and accordingly, the cam mechanism 43 switches the holder 41 to the holding mode or the releasing mode corresponding to the position in which the holder 41 is disposed. In detail, the cam mechanism 43 switches the holder 41 from the releasing mode to the holding mode when the holder 41 rotates from the initial position to the holding position, keeps the holder 41 in the holding mode when the holder 41 rotates from the holding position to the standby position, switches the holder 41 from the holding mode to the releasing mode when the holder 41 rotates from the standby position to the hold releasing position, and keeps the holder 41 in the releasing mode when the holder 41 rotates from the hold releasing position to the initial position.

The paper discharge unit 17 further includes a discharge guide 45, the stopper 46, a discharge assist claw 47, and a flexible assist claw 48. The discharge guide 45 is formed of a bent plate, and is fixed to the transport path 5 in a state of being disposed along a trajectory on which the holder 41 rotates, that is, along a side surface of a cylinder having the rotation axis 44 as a central axis. The stopper 46 has a substantially flat plate shape. The stopper 46 is disposed between the discharge guide 45 and the exit tray 3 so as to extend along a plane overlapping the rotation axis 44, and is fixed to the discharge guide 45.

The discharge assist claw 47 has a plate shape, and is fixed to the holder 41 so as to rotate about the rotation axis 44 together with the holder 41. The discharge assist claw 47 is disposed so as to pass near the discharge roller pair 36 of the discharger 32 when the holder 41 rotates from the standby position to the hold releasing position.

The flexible assist claw 48 is formed into a plate shape using an elastically deformable resin material, and is fixed to the discharge assist claw 47 so as to rotate about the rotation axis 44 together with the holder 41. The flexible assist claw 48 contacts the placement surface 27 of the exit tray 3 when the holder 41 rotates from the holding position to the standby position.

Figure 4:
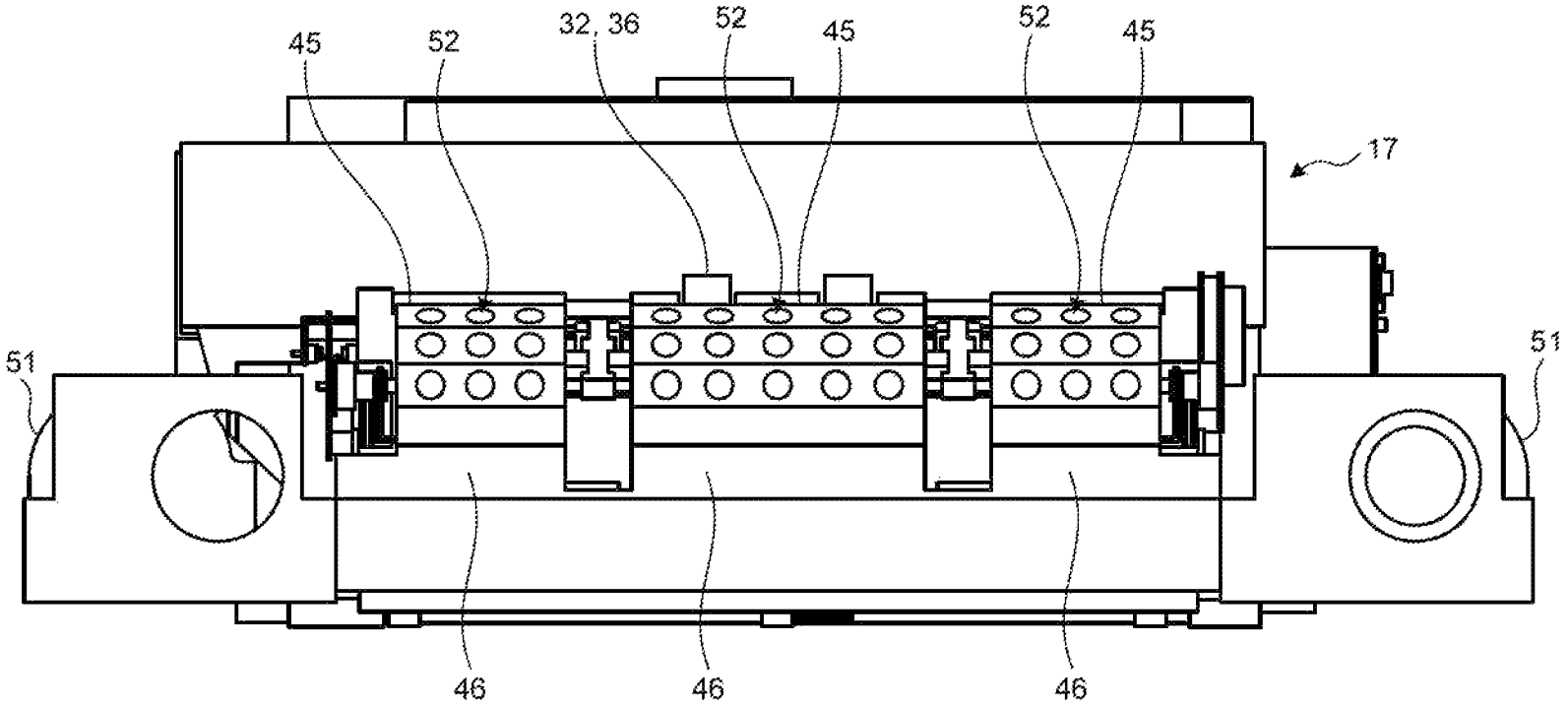
FIG. 4 is a rear view illustrating the paper discharge unit of the medium reversing and discharging device according to the first embodiment.

FIG. 4 is a rear view illustrating the paper discharge unit 17 of the medium reversing and discharging device according to the first embodiment. The paper discharge unit 17 further includes a medium reversing blower 51. The discharge guide 45 has a plurality of air holes 52. The medium reversing blower 51 blows air out of the air holes 52.

Figure 5:
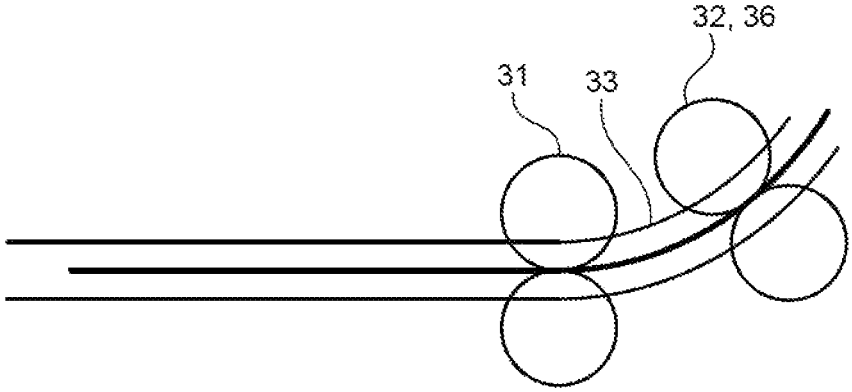
FIG. 5 is a side view illustrating a curved portion of the medium reversing and discharging device according to the first embodiment.

FIG. 5 is a side view illustrating the curved portion 33 of the medium reversing and discharging device according to the first embodiment. The curved portion 33 guides the medium transported by the transport roller pair 31 to the discharger 32. The path formed by the curved portion 33 is curved. The curved portion 33 curves the medium when the medium is supplied from the transport roller pair 31 to the discharger 32.

Figure 6:
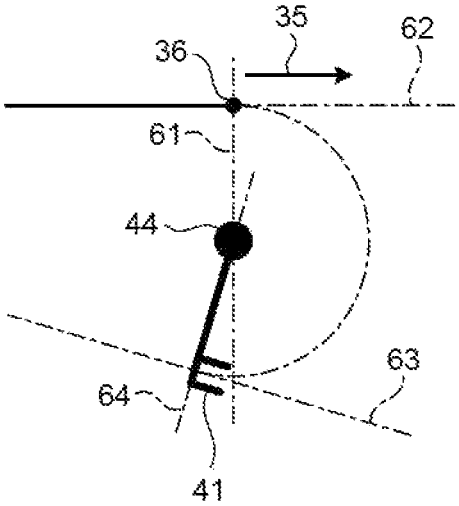
FIG. 6 is a schematic side view illustrating the paper discharge unit of the medium reversing and discharging device according to the first embodiment when a holder is disposed in a standby position.

FIG. 6 is a schematic side view illustrating the paper discharge unit 17 of the medium reversing and discharging device according to the first embodiment when the holder 41 is disposed in the standby position. The discharge roller pair 36 of the discharger 32 is disposed such that the paper discharge direction 35 is substantially orthogonal to a plane 61 overlapping the discharge roller pair 36 and the rotation axis 44. A paper discharge plane 62 along a portion of the medium discharged from the discharger 32 pinched by the discharge roller pair 36 is parallel to the paper discharge direction 35. A holding plane 63 along a portion of the medium held by the holder 41 is substantially orthogonal to a plane 64 overlapping the holder 41 and the rotation axis 44 when the holder 41 is disposed in the standby position.

Figure 7:
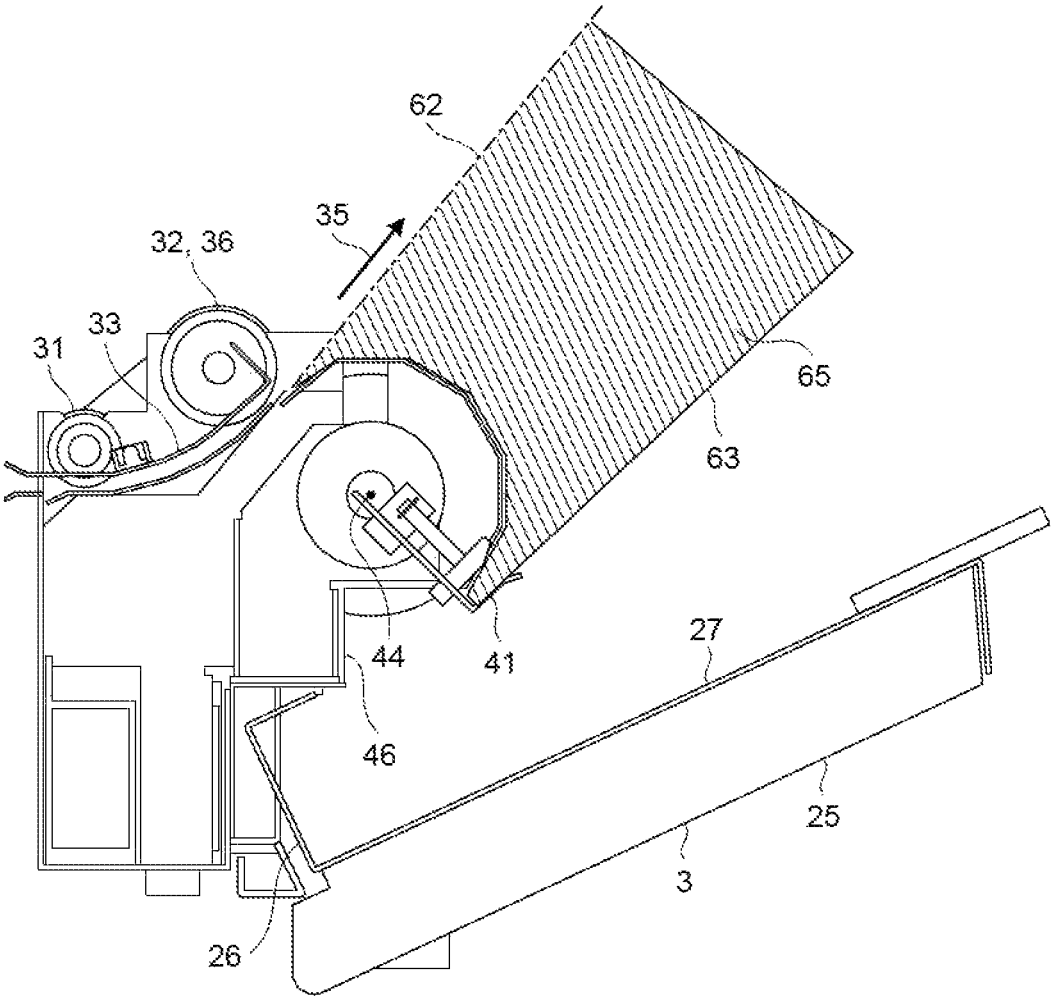
FIG. 7 is a sectional view illustrating the paper discharge unit of the medium reversing and discharging device according to the first embodiment when the holder is disposed in the standby position.

FIG. 7 is a sectional view illustrating the paper discharge unit 17 of the medium reversing and discharging device according to the first embodiment when the holder 41 is disposed in the standby position. When the holder 41 is disposed in the standby position, the holder 41 is disposed on the downstream side of the stopper 46 and the upstream side of the plane 61 in the paper discharge direction 35 (refer to FIG. 6). When the holder 41 is disposed in the standby position, the holding plane 63 intersects with the paper discharge plane 62 on the upstream side in the paper discharge direction 35 of the plane 61. The medium discharged from the discharger 32 is disposed in a space 65 when the holder 41 is disposed in the standby position. The space 65 refers to a space defined by the paper discharge direction 35 and the holding plane 63.

Figure 8:
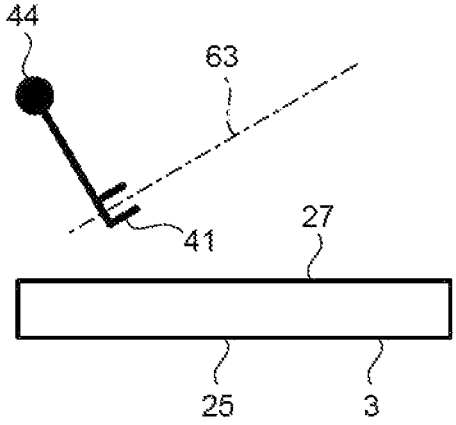
FIG. 8 is a schematic side view illustrating the paper discharge unit and the exit tray of the medium reversing and discharging device according to the first embodiment when the holder is disposed in the standby position.

FIG. 8 is a schematic side view illustrating the paper discharge unit 17 and the exit tray 3 of the medium reversing and discharging device according to the first embodiment when the holder 41 is disposed in the standby position. The exit tray 3 is disposed such that the placement surface 27 of the exit tray 3 does not intersect with the holding plane 63 when the holder 41 is disposed in the standby position.

The image reading device 1 further includes a controller, which is not illustrated. The controller is a computer, and includes a central processing unit (CPU), a storage device, an input/output device, a communication interface, and a media interface. The CPU executes a computer program installed in the controller to process information and control the storage device, the input/output device, the communication interface, and the media interface. The CPU executes a computer program installed in the controller to further control elements provided in the image reading device 1. Examples of the storage device include memories such as a random access memory (RAM) and a read-only memory (ROM), a fixed disk device such as a hard disk, and a solid-state drive (SSD). The storage device records the computer programs installed in the controller, and records information used by the CPU. The input/output device outputs information generated by operation performed by a user to the CPU, and outputs information generated by the CPU so as to be recognizable by the user.

The CPU controls the communication interface to download information from another computer connected through a communication line to the controller, or transmit information from the controller to the other computer. A non-transitory tangible recording medium can be mounted on the media interface. Examples of the recording medium include a semiconductor memory, a magnetic disk, a magneto-optical disk, and an optical disc. The CPU controls the media interface to read information from the recording medium or record information on the recording medium when the recording medium is mounted. The computer programs installed in the controller may be downloaded from another computer through the communication interface, or may be read from a recording medium through the media interface.

Operation of Image Reading Device 1

When the user intends to use the image reading device 1 to read images from a plurality of media, the user places the media on the document table 2, and operates the input/output device of the controller to start the image reading device 1. The media placed on the document table 2 include single-sheet media or a bound medium. The single-sheet media may each be a Z-folded medium folded into a Z-shape. After the image reading device 1 starts, the controller controls the first paper feed unit 11 to detect whether the media are placed on the document table 2. When the controller has detected that the media are placed on the document table 2, the controller controls the first paper feed unit 11 to feed one medium disposed on the top of the media placed on the document table 2 to the transport path 5 to supply the fed medium to the processing unit 12.

The controller further controls the processing unit 12 to detect whether the medium supplied from the first paper feed unit 11 is a bound medium or a single-sheet medium, and, when the medium is detected to be the bound medium, controls the processing unit 12 to remove the binding member or members from the bound medium.

When the medium transported between the transport mechanism 14 and the second paper feed unit 15 is Z-folded, the unfolding unit 16 unfolds the medium. That is, the z-folded medium transported from the transport mechanism 14 to the second paper feed unit 15 is unfolded by passing through the unfolding unit 16, and is supplied to the second paper feed unit 15 in an unfolded state.

When the medium is supplied from the second paper feed unit 15 to the paper discharge unit 17, the controller controls the reading unit 18 to read the images on both surfaces of the medium transported from the second paper feed unit 15 to the paper discharge unit 17, and record the read images. The controller controls the paper discharge unit 17 to reverse the medium supplied from the second paper feed unit 15 to the paper discharge unit 17, and place the medium on the exit tray 3.

The controller repeatedly performs the above-described operation until the first paper feed unit 11 detects that no medium is placed on the document table 2. The image reading device 1 can read the respective images on the media placed on the document table 2 by performing the above-described operation.

Figure 9:
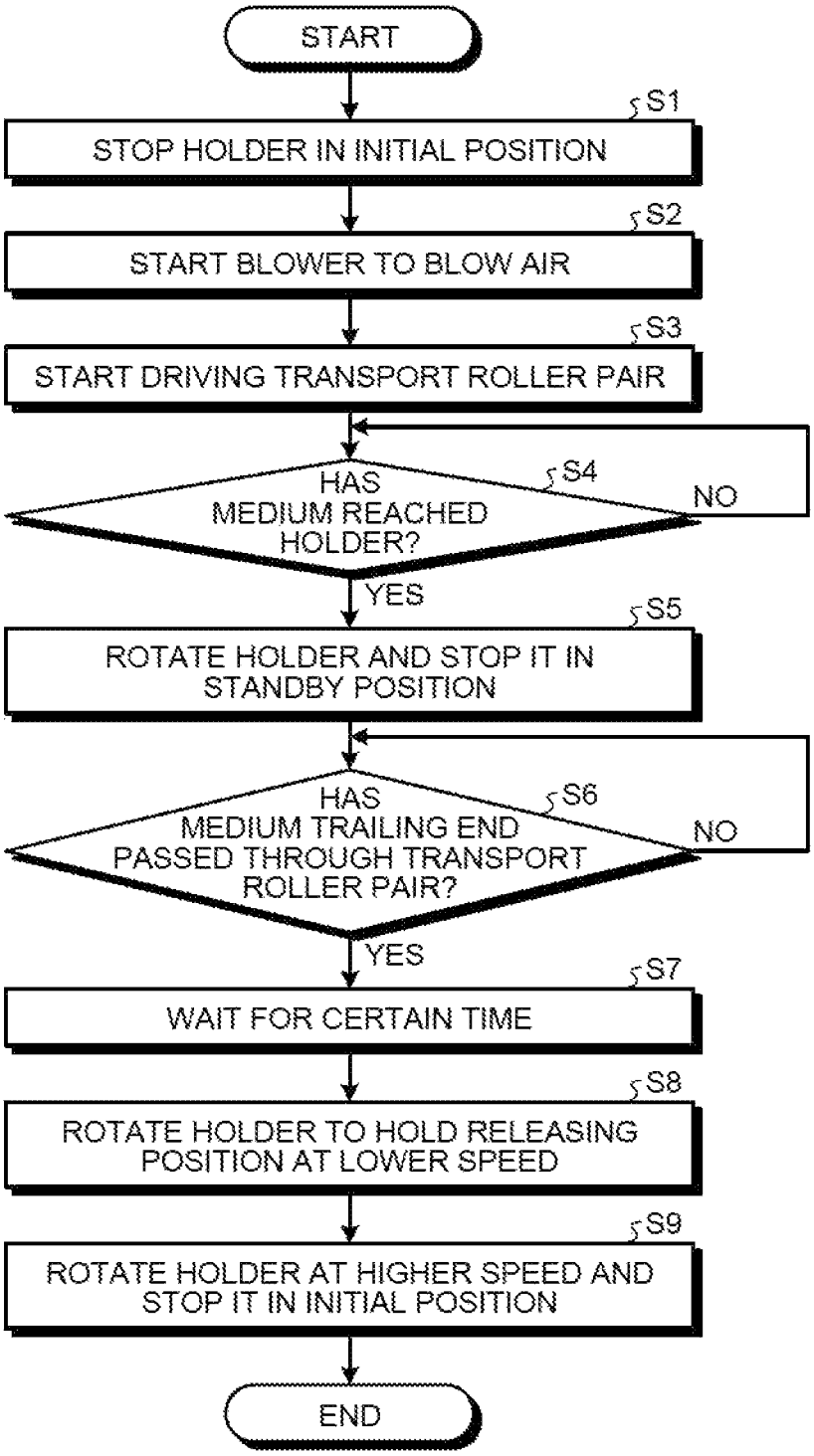
FIG. 9 is a flowchart illustrating an operation of the paper discharge unit of the medium reversing and discharging device according to the first embodiment.

FIG. 9 is a flowchart illustrating an operation of the paper discharge unit 17 of the medium reversing and discharging device according to the first embodiment. After the image reading device 1 starts, the controller controls the driver 42 to dispose the holder 41 in the initial position (Step S1).

When the holder 41 is disposed in the initial position, the holder 41 has been switched to the releasing mode by the cam mechanism 43. The controller further controls the medium reversing blower 51 to blow air out of the air holes 52 of the discharge guide 45 (Step S2). The controller further controls the transport roller pair 31 to supply the medium supplied to the paper discharge unit 17 to the curved portion 33 (Step S3). The medium supplied to the curved portion 33 is curved, and a bending tendency is corrected. The medium supplied to the curved portion 33 is further guided through the curved portion 33, and is supplied to the discharger 32.

Figure 10:
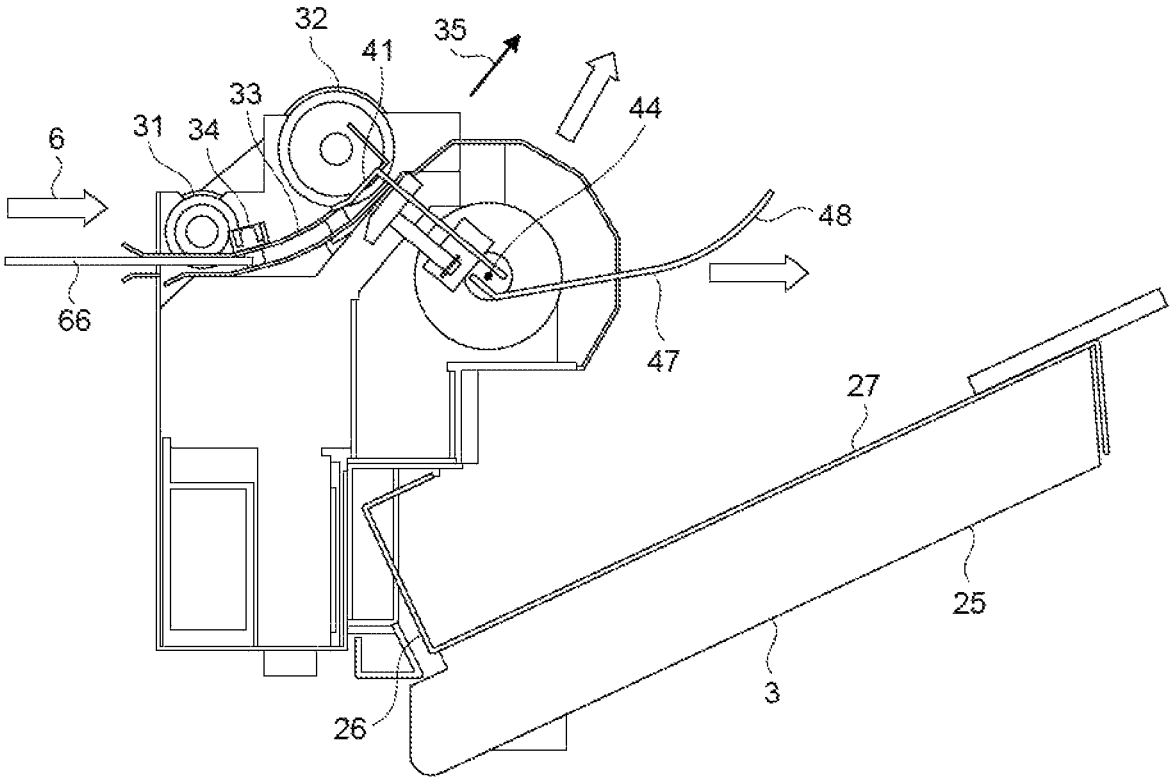
FIG. 10 is a sectional view illustrating the paper discharge unit of the medium reversing and discharging device according to the first embodiment when a leading end of a medium is detected by a position detection sensor.
Figure 11:
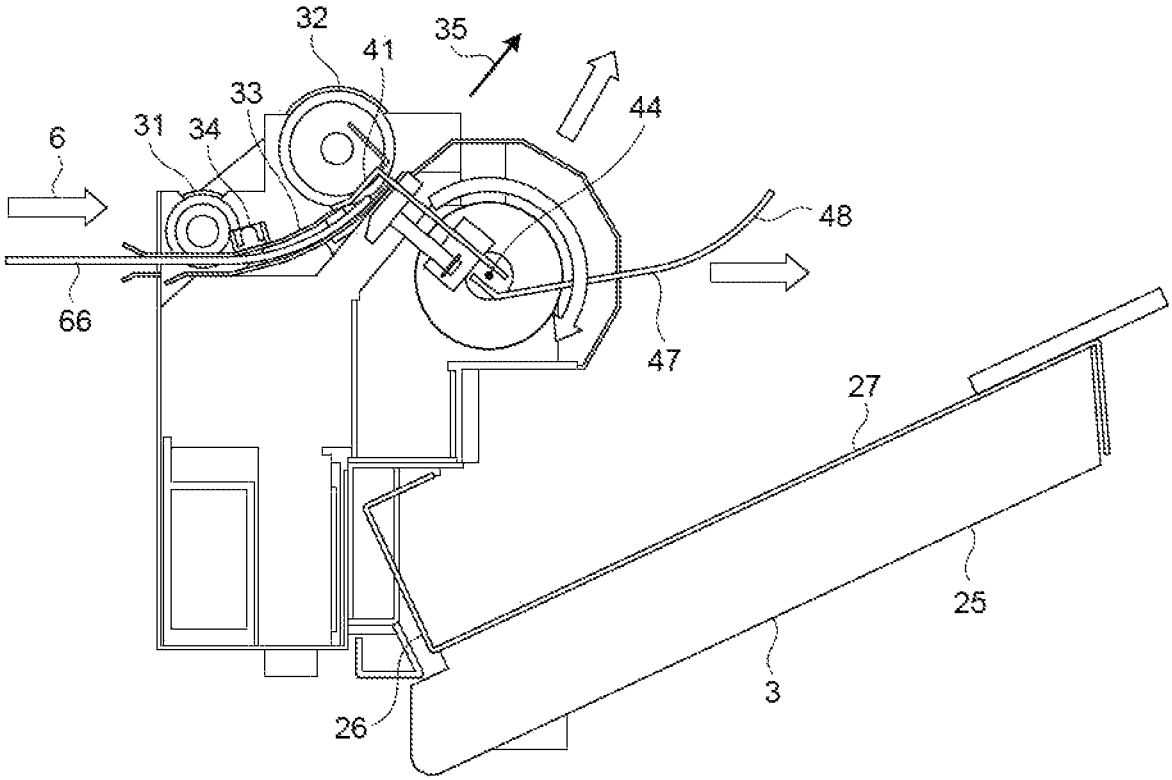
FIG. 11 is a sectional view illustrating the paper discharge unit of the medium reversing and discharging device according to the first embodiment when the leading end of the medium has reached the holder.

The controller further controls the position detection sensor 34 to detect a time when a leading end of the medium transported by the transport roller pair 31 reaches the predetermined position between the transport roller pair 31 and the discharger 32. FIG. 10 is a sectional view illustrating the paper discharge unit 17 of the medium reversing and discharging device according to the first embodiment when the leading end of the medium is detected by the position detection sensor 34. After the leading end of a medium 66 transported by the transport roller pair 31 passes through the predetermined position, the medium 66 is transported in the paper discharge direction 35 from the discharger 32, and reaches the holder 41 at a time when a predetermined time has elapsed from the time when the leading end has reached the predetermined position. FIG. 11 is a sectional view illustrating the paper discharge unit 17 of the medium reversing and discharging device according to the first embodiment when the leading end of the medium has reached the holder 41.

The controller calculates the time when the leading end of the medium 66 reaches the holder 41 based on the time at which the position detection sensor 34 detected the leading end of the medium 66. The controller controls the driver 42 to rotate the holder 41 from the initial position toward the holding position when the calculated time is reached (Yes at Step S4). When the holder 41 rotates from the initial position toward the holding position, the holder 41 is switched from the releasing mode to the holding mode by the cam mechanism 43, and holds the medium discharged from the discharger 32.

After the medium is held by the holder 41, the controller controls the driver 42 to rotate the holder 41 from the holding position to the standby position such that the absolute value of a discharge speed at which the medium is discharged is equal to the absolute value of a circumferential velocity of the holder 41. The circumferential velocity is equal to a value obtained by multiplying an angle (in radians) per unit time of the rotation of the holder 41 about the rotation axis 44 by a distance between the rotation axis 44 and the holder 41. Since the absolute value of the discharge speed is equal to the absolute value of the circumferential velocity, the medium 66 is transported along the trajectory of the holder 41, that is, along the discharge guide 45 when the holder 41 rotates. When the holder 41 has rotated to the standby position, the controller controls the driver 42 to stop the rotation of the holder 41 (Step S5).

Figure 12:
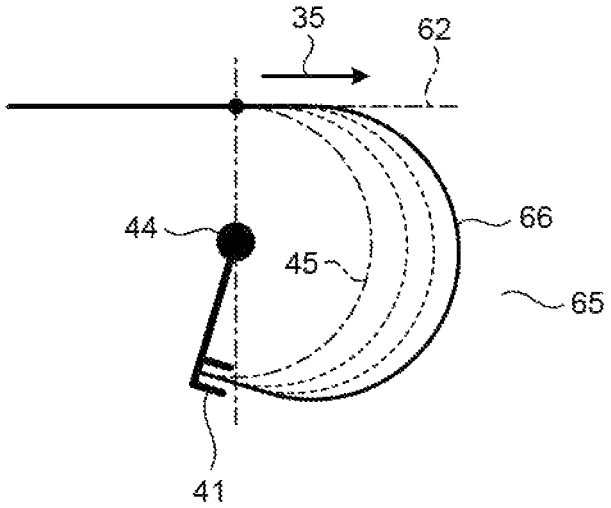
FIG. 12 is a schematic side view illustrating the medium when the holder is stopped in the standby position.

When the holder 41 is stopped in the standby position, the medium 66 is discharged from the discharger 32 to be loosened so as not to follow the discharge guide 45. FIG. 12 is a schematic side view illustrating the medium 66 when the holder 41 is stopped in the standby position. The discharge guide 45 prevents the medium 66 from being deformed so as to come closer to the rotation axis 44 when the medium 66 is loosened. The medium reversing blower 51 blows air onto the medium 66 in a direction away from the rotation axis 44 to prevent the medium 66 from being deformed so as to come closer to the rotation axis 44 when the medium 66 is loosened. At this time, the medium 66 is deformed to have a larger radius of curvature, that is, to expand toward the downstream side in the paper discharge direction 35 in the space 65. The medium 66 is deformed to have a larger radius of curvature, and thus, buckling of the medium 66 is prevented.

Figure 13:
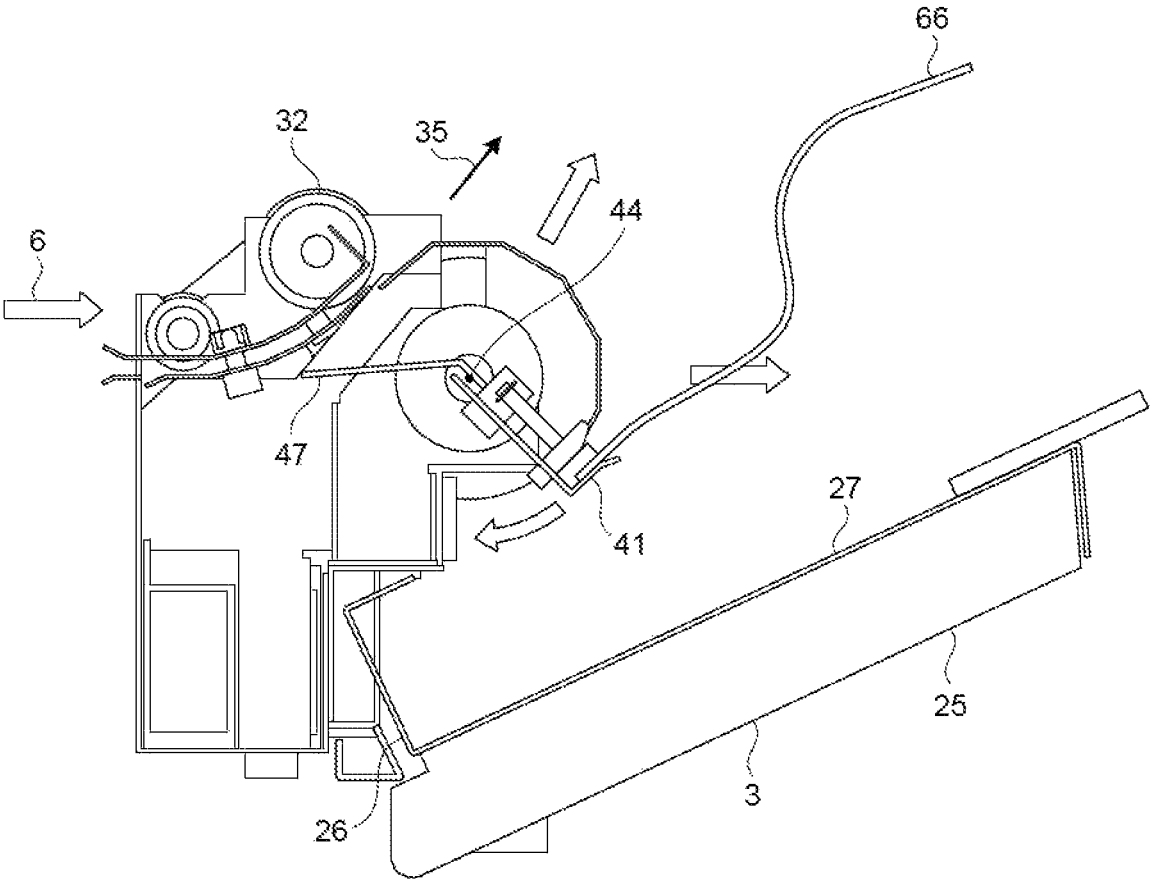
FIG. 13 is a sectional view illustrating the paper discharge unit of the medium reversing and discharging device according to the first embodiment when a trailing end of the medium has been released from a discharger.
Figure 14:
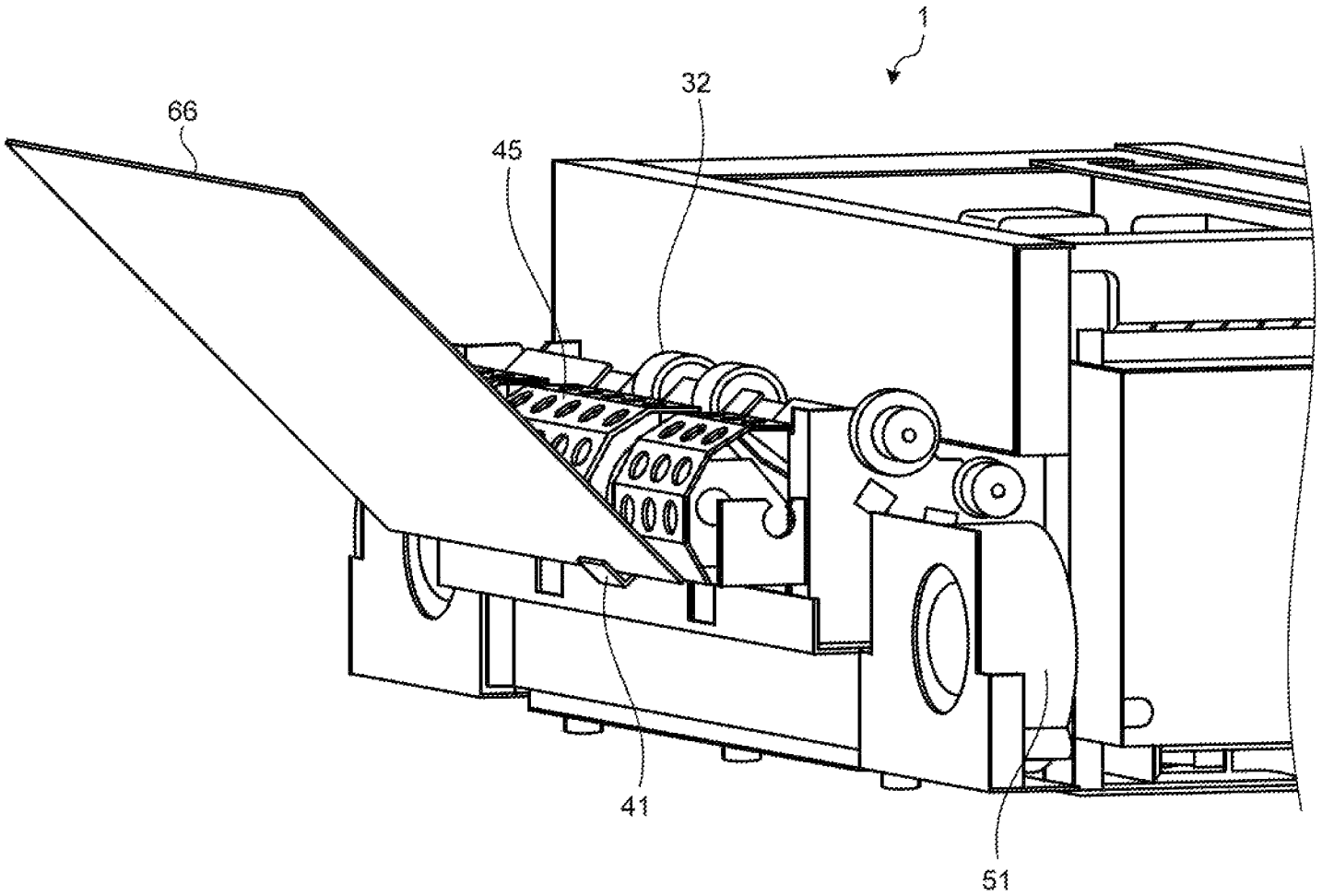
FIG. 14 is a perspective view illustrating the paper discharge unit of the medium reversing and discharging device according to the first embodiment when the trailing end of the medium has been released from the discharger.

When the holder 41 is disposed in the standby position, the controller controls the position detection sensor 34 to detect a time when a trailing end of the medium 66 passes through the predetermined position between the transport roller pair 31 and the discharger 32. The trailing end of the medium 66 is released from the discharger 32 at a time when a predetermined time has elapsed from the time when the medium 66 has passed the predetermined position. After a predetermined time has elapsed from the time when the trailing end has been released from the discharger 32, the medium 66 is reversed by stiffness of the medium 66 and the air blow of the medium reversing blower 51 such that the trailing end of the medium 66 locates on the downstream side in the transport direction 6 of the leading end of the medium 66. FIG. 13 is a sectional view illustrating the paper discharge unit 17 of the medium reversing and discharging device according to the first embodiment when the trailing end of the medium 66 has been released from the discharger 32. FIG. 14 is a perspective view illustrating the paper discharge unit 17 of the medium reversing and discharging device according to the first embodiment when the trailing end of the medium 66 has been released from the discharger 32.

The controller calculates the time after the predetermined time has elapsed from the time when the medium 66 has been released from the discharger 32 based on the time when the trailing end of the medium 66 has passed through the predetermined position. After the trailing end of the medium 66 has been released from the discharger 32 (Yes at Step S6), the controller waits until the calculated time is reached (Step S7). When the calculated time has been reached, the controller controls the driver 42 to rotate the holder 41 from the standby position to the hold releasing position at a circumferential velocity lower than the circumferential velocity at which the holder 41 has rotated from the holding position to the standby position (Step S8). When the holder 41 rotates from the standby position to the hold releasing position, the holder 41 is switched from the holding mode to the releasing mode by the cam mechanism 43 to release the medium 66.

After the medium 66 is released from the discharger 32, the trailing end of the medium 66 may remain near the discharge roller pair 36 of the discharger 32. When the holder 41 rotates from the standby position to the hold releasing position, the discharge assist claw 47 passes near the discharge roller pair 36 to contact the trailing end of the medium 66 remaining near the discharge roller pair 36, and separates the trailing end of the medium 66 from the discharge roller pair 36. After the trailing end of the medium 66 is released from the discharger 32, the trailing end of the medium 66 is separated from the discharge roller pair 36, and thus, the medium 66 can be appropriately reversed.

Figure 15:
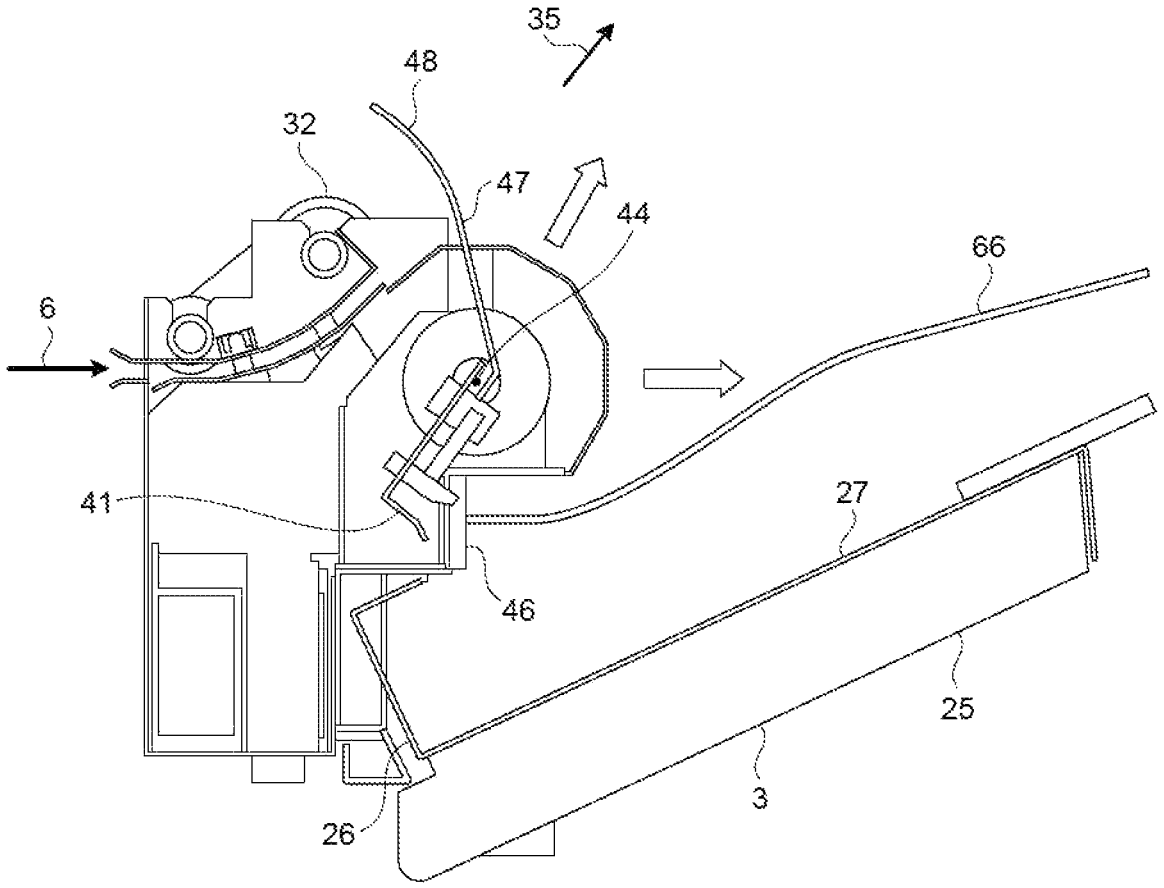
FIG. 15 is a sectional view illustrating the paper discharge unit of the medium reversing and discharging device according to the first embodiment when the medium has come off the holder.
Figure 16:
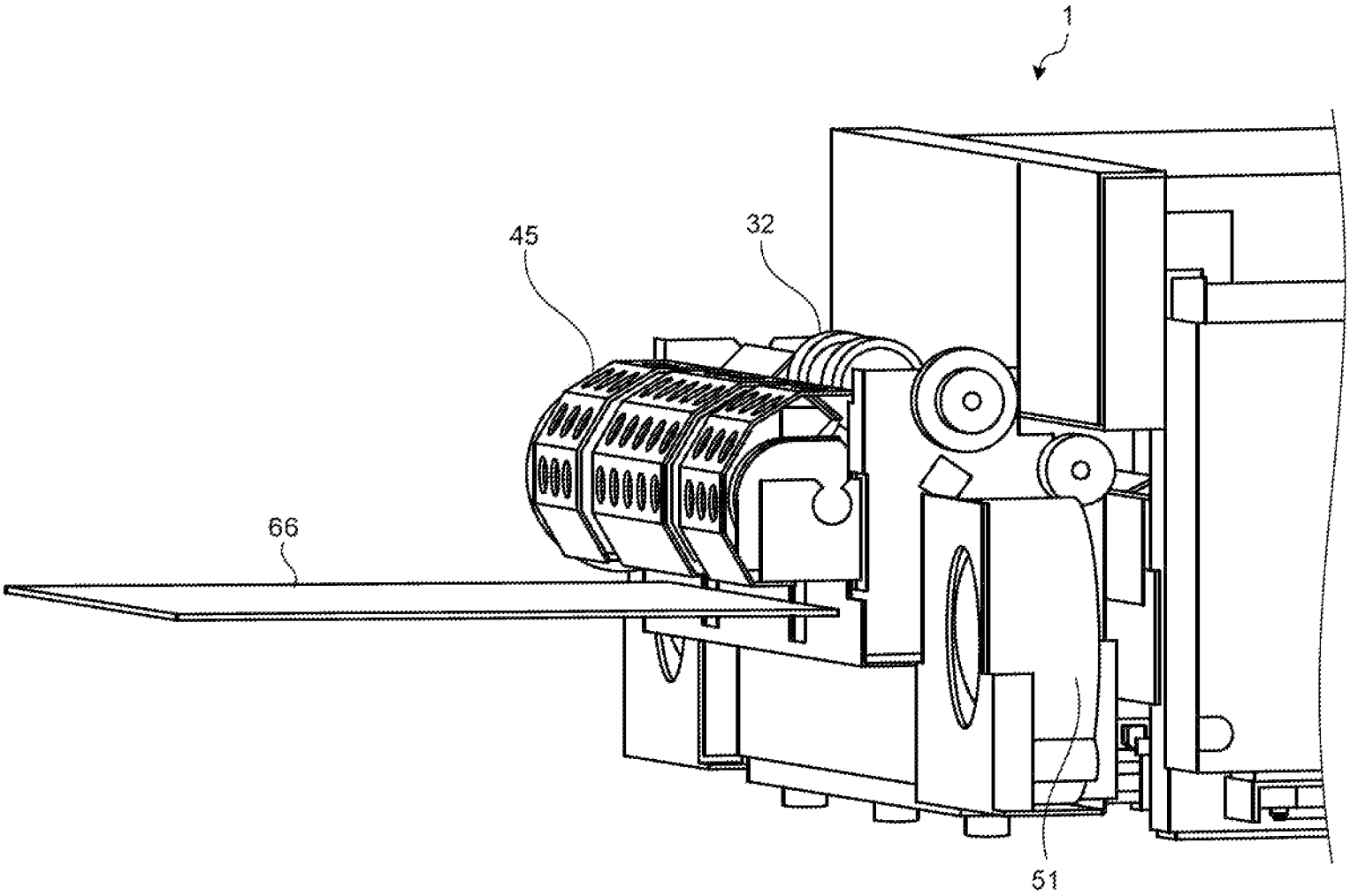
FIG. 16 is a perspective view illustrating the paper discharge unit of the medium reversing and discharging device according to the first embodiment when the medium has come off the holder.

When the holder 41 rotates from the standby position to the hold releasing position, the leading end of the medium 66 abuts on the stopper 46, and thus, the medium 66 comes off the holder 41. FIG. 15 is a sectional view illustrating the paper discharge unit 17 of the medium reversing and discharging device according to the first embodiment when the medium 66 has come off the holder 41. FIG. 16 is a perspective view illustrating the paper discharge unit 17 of the medium reversing and discharging device according to the first embodiment when the medium 66 has come off the holder 41.

Figure 17:
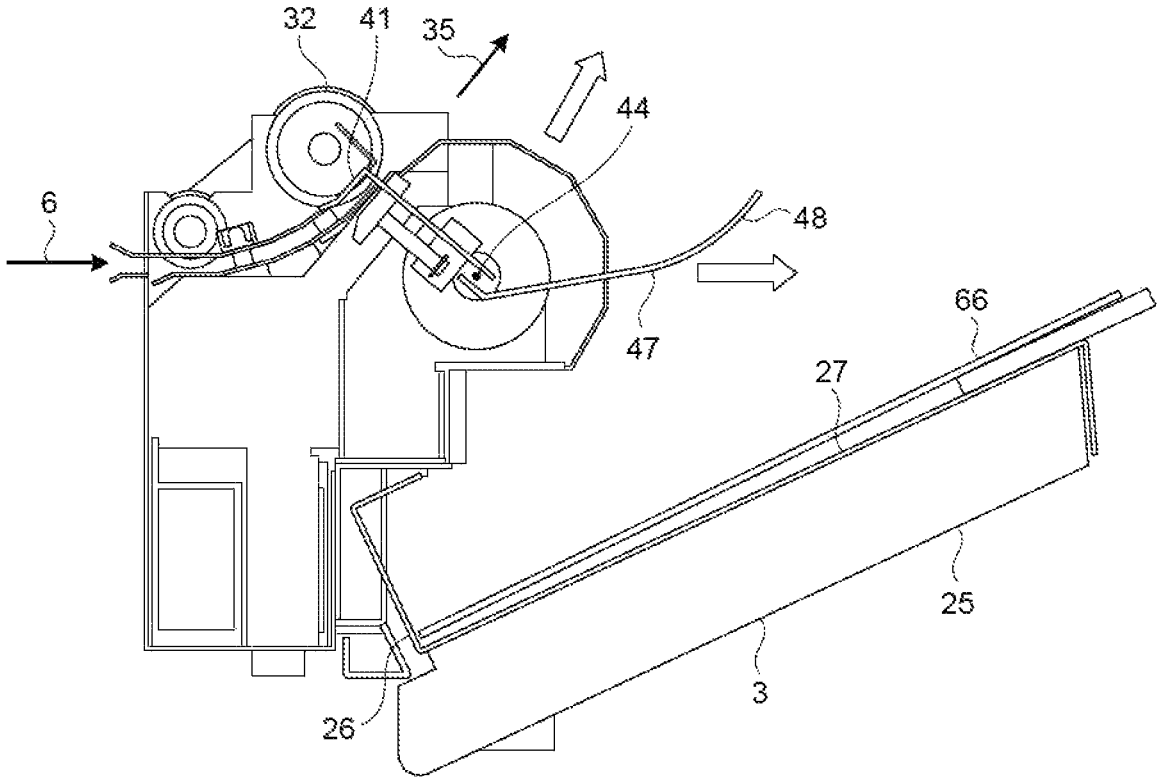
FIG. 17 is a sectional view illustrating the paper discharge unit of the medium reversing and discharging device according to the first embodiment when the medium has been placed on the exit tray.

After coming off the holder 41, the medium 66 falls and is placed on the exit tray 3. Since the exit tray 3 is inclined, the medium 66 is moved by gravity toward the upstream side in the transport direction 6 after being placed on the exit tray 3, and the leading end of the medium 66 abuts on the stopper 26. FIG. 17 is a sectional view illustrating the paper discharge unit 17 of the medium reversing and discharging device according to the first embodiment when the medium 66 has been placed on the exit tray 3. The leading end of the medium 66 abuts on the stopper 26, so that the leading ends of media placed on the exit tray 3 are aligned.

After the holder 41 reaches the hold releasing position, the controller rotates the holder 41 from the hold releasing position to the initial position at a circumferential velocity higher than the circumferential velocity at which the holder 41 has rotated from the holding position to the standby position (Step S9).

Figure 18:
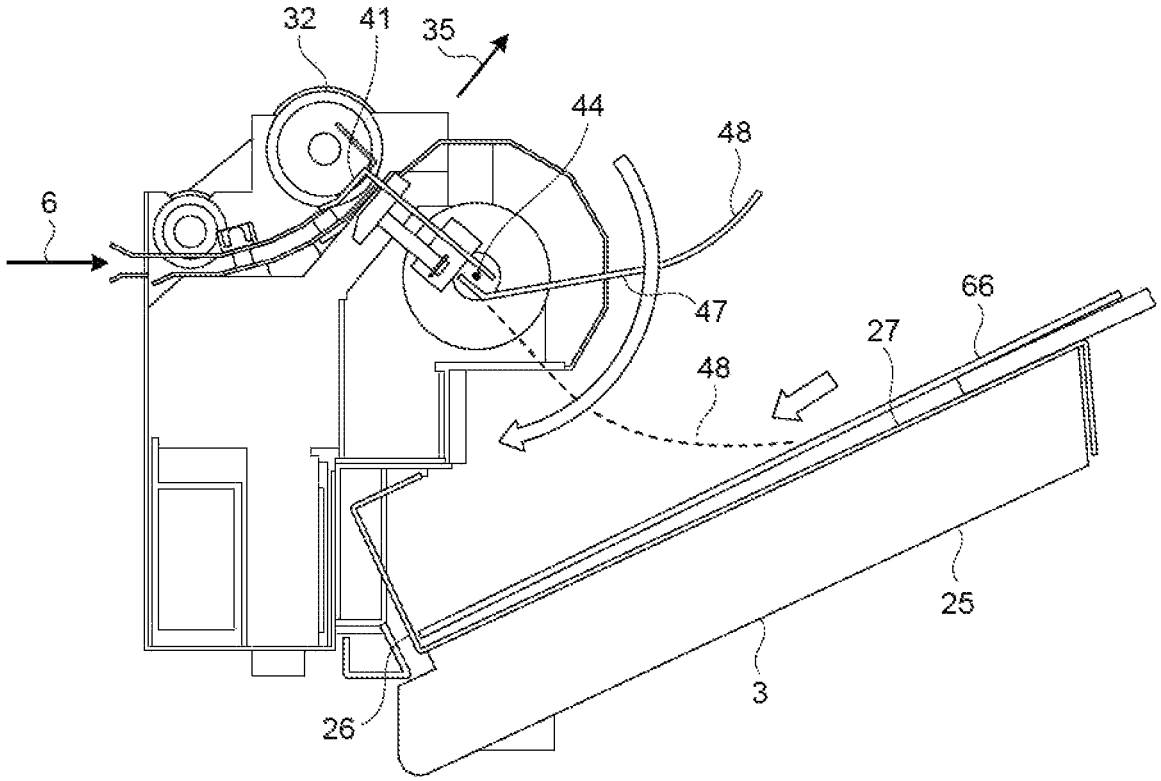
FIG. 18 is a sectional view illustrating the paper discharge unit of the medium reversing and discharging device according to the first embodiment when a flexible assist claw contacts the medium.

The controller repeatedly executes the processing of the flow in FIG. 9 when the next medium different from the medium 66 is supplied to the paper discharge unit 17 after the holder 41 rotates to the initial position. Through the execution of the processing of the flow in FIG. 9, the flexible assist claw 48 rotates about the rotation axis 44 to contact the medium 66 so as to move the medium 66 toward the upstream side in the transport direction 6. FIG. 18 is a sectional view illustrating the paper discharge unit 17 of the medium reversing and discharging device according to the first embodiment when the flexible assist claw 48 contacts the medium 66. After the medium 66 is placed on the exit tray 3, the leading end of the medium 66 may not be moved by gravity toward the upstream side in the transport direction 6 to abut on the stopper 26. Even in such a case, the medium 66 is moved toward the upstream side in the transport direction 6 by contacting with the flexible assist claw 48, and the leading end of the medium 66 abuts on the stopper 26. As a result, the image reading device 1 can cause the leading end of the medium placed on the exit tray 3 to abut on the stopper 26, and thus, can align the leading ends of the media placed on the exit tray 3.

The image reading device 1 rotates the holder 41 from the hold releasing position to the initial position at the circumferential velocity higher than the circumferential velocity at which the holder 41 has rotated from the holding position to the standby position, and thus, can shorten the time until a medium next to the medium 66 is held by the holder 41. As a result, the image reading device 1 can shorten the time required for the operation to reverse the media and place them on the exit tray 3.

Medium Reversing and Discharging Device of Comparative Example

Figure 19:
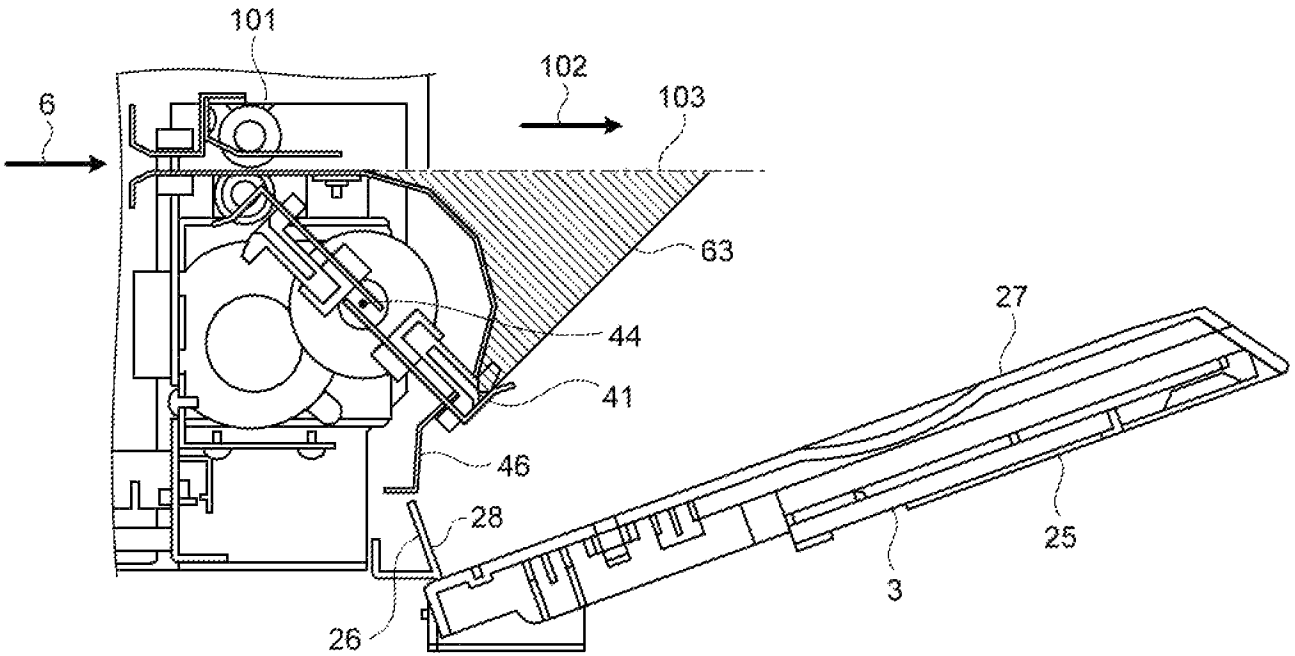
FIG. 19 is a sectional view illustrating a discharge roller pair of a medium reversing and discharging device of a comparative example.

In a medium reversing and discharging device of a comparative example, as illustrated in FIG. 19, the discharge roller pair 36 of the paper discharge unit 17 of the medium reversing and discharging device according to the first embodiment described above is replaced with another discharge roller pair 101, and the other parts are the same as those of the medium reversing and discharging device according to the first embodiment described above. FIG. 19 is a sectional view illustrating the discharge roller pair 101 of the medium reversing and discharging device of the comparative example. In the same way as the discharge roller pair 36 described above, the rollers of the discharge roller pair 101 are close to each other so as to pinch the medium supplied from the transport roller pair 31. When the medium is pinched by the discharge roller pair 101, the discharge roller pair 101 rotates to supply the medium in a paper discharge direction 102. The paper discharge direction 102 is substantially parallel to the transport direction 6.

Figure 20:
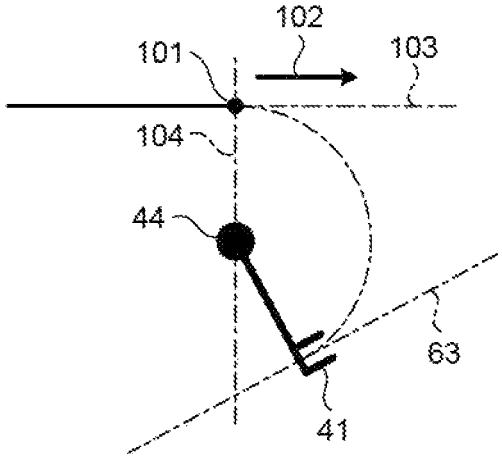
FIG. 20 is a schematic side view illustrating a paper discharge unit of the medium reversing and discharging device of the comparative example when the holder is stopped in the standby position.

FIG. 20 is a schematic side view illustrating a paper discharge unit of the medium reversing and discharging device of the comparative example when the holder 41 is stopped in the standby position. A paper discharge plane 103 along a portion of the medium discharged from the discharge roller pair 101 pinched by the discharge roller pair 101 is parallel to the paper discharge direction 102. When the holder 41 is disposed in the standby position, the holding plane 63 intersects with the paper discharge plane 103 on the downstream side in the paper discharge direction 102 of a plane 104 overlapping the discharge roller pair 101 and the rotation axis 44.

Figure 21:
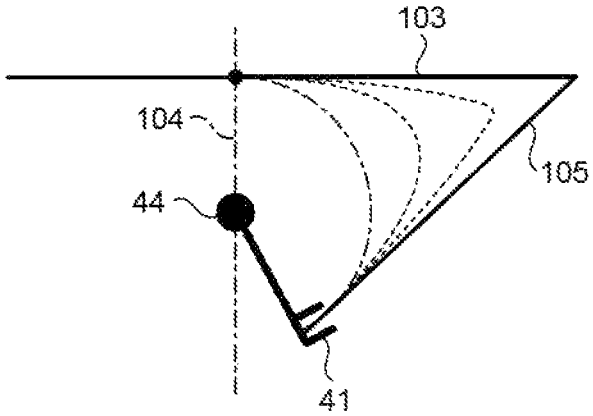
FIG. 21 is a schematic side view illustrating a medium when the holder is stopped in the standby position in the medium reversing and discharging device of the comparative example.

FIG. 21 is a schematic side view illustrating a medium 105 when the holder 41 is stopped in the standby position in the medium reversing and discharging device of the comparative example. When the holder 41 is stopped in the standby position, the medium 105 held by the holder 41 is discharged from the discharge roller pair 101, whereby the medium 105 may be deformed so as to partially have a smaller radius of curvature, and may buckle. The above-described medium reversing and discharging device according to the first embodiment can prevent the medium from buckling as compared with the medium reversing and discharging device of the comparative example.

Effects of Medium Reversing and Discharging Device According to First Embodiment The medium reversing and discharging device according to the first embodiment includes the discharger 32, the holder 41, and the driver 42. The discharger 32 discharges the medium 66 in the paper discharge direction 35 from the discharge roller pair 36. The holder 41 holds the medium 66. The driver 42 moves the holder 41. At this time, the moving speed at which the holder 41 moves is lower than the discharge speed at which the medium 66 is discharged from the discharge roller pair 36. In addition, when the holder 41 is disposed in the standby position, the paper discharge plane 62 along the portion of the medium 66 in contact with the discharge roller pair 36 does not intersect with the holding plane 63 along the portion of the medium 66 held by the holder 41 on the downstream side in the paper discharge direction 35 of the discharge roller pair 36. Such a medium reversing and discharging device can loosen the medium 66 on the downstream side in the paper discharge direction 35, and reverse the medium 66 without causing the buckling when the holder 41 is disposed in the standby position.

The medium reversing and discharging device according to the first embodiment further includes the medium reversing blower 51 that blows air onto the medium 66. Such a medium reversing and discharging device can appropriately loosen and reverse the medium 66 even if the stiffness of the medium 66 is small.

Although the medium reversing and discharging device according to the first embodiment includes the medium reversing blower 51, the medium reversing blower 51 may be eliminated. Even in this case, the medium reversing and discharging device can prevent the medium 66 from buckling because the paper discharge plane 62 dose not intersect with the holding plane 63 on the downstream side in the paper discharge direction 35 of the discharge roller pair 36 when the holder 41 is disposed in the standby position.

The holder 41 of the medium reversing and discharging device according to the first embodiment is supported so as to be rotatable about the rotation axis 44. The driver 42 rotates the holder 41 about the rotation axis 44 such that the circumferential velocity of the holder 41 is lower than the discharge speed when the holder 41 is disposed on the upstream side in the paper discharge direction 35 of the plane 61 overlapping the rotation axis 44 and the discharge roller pair 36. In such a medium reversing and discharging device, the driver 42 can be constituted by, for example, one motor. Thus, the manufacturing cost can be reduced.

The medium reversing and discharging device according to the first embodiment further includes the exit tray body 25, the stopper 26, and the flexible assist claw 48. The medium 66 is placed on the exit tray body 25 after being released from the holder 41. The stopper 26 faces the leading end of the medium 66 when the medium 66 is placed on the exit tray body 25. When the medium 66 is placed on the exit tray body 25, the flexible assist claw 48 contacts the medium 66 by moving together with the holder 41. Such a medium reversing and discharging device need not be provided with a mechanism for moving the flexible assist claw 48 for aligning the leading end of the medium 66 separately from the driver 42, and can be reduced in manufacturing cost.

Although the medium reversing and discharging device according to the first embodiment includes the flexible assist claw 48, the flexible assist claw 48 may be eliminated. Even in this case, the medium reversing and discharging device can prevent the medium 66 from buckling because the paper discharge plane 62 dose not intersect with the holding plane 63 on the downstream side in the paper discharge direction 35 of the discharge roller pair 36 when the holder 41 is disposed in the standby position.

The medium reversing and discharging device according to the first embodiment further includes the curved portion 33 that curves the medium 66 before the medium 66 is discharged from the discharge roller pair 36. Such a medium reversing and discharging device can correct the bending tendency of the medium 66 to prevent the medium 66 from buckling.

Medium Reversing and Discharging Device According to First Modification

Figure 22:
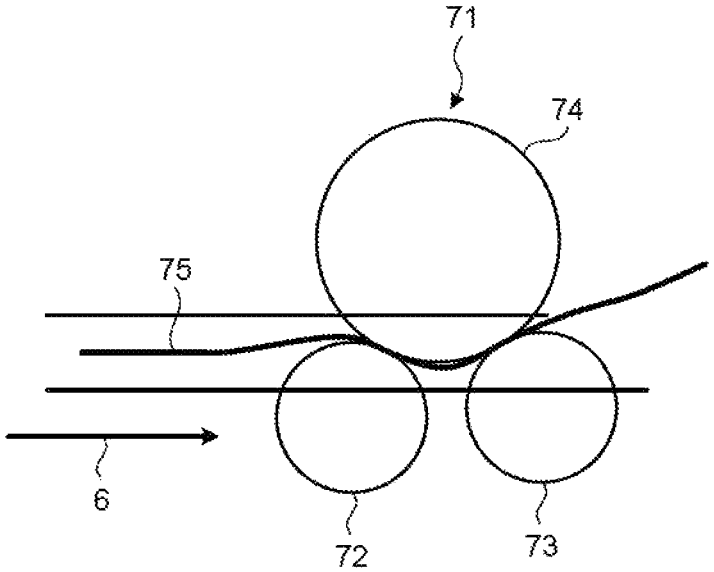
FIG. 22 is a side view illustrating a curving unit of a medium reversing and discharging device according to a first modification.

Although the curved portion 33 of the medium reversing and discharging device according to the first embodiment described above curves the medium with the path for transporting the medium, other means may be used to curve the medium. In a medium reversing and discharging device according to a first modification, as illustrated in FIG. 22, the curved portion 33 of the medium reversing and discharging device according to the first embodiment described above is replaced with a curving unit 71, and the other parts are the same as those of the medium reversing and discharging device according to the first embodiment described above. FIG. 22 is a side view illustrating the curving unit 71 of the medium reversing and discharging device according to the first modification. The curving unit 71 includes a first roller 72, a second roller 73, and a third roller 74. The first roller 72 and the second roller 73 are cylindrical, and are disposed below the path connecting the transport roller pair 31 to the discharger 32. The third roller 74 is cylindrical, and is disposed above the path connecting the transport roller pair 31 to the discharger 32. The third roller 74 is disposed between the first roller 72 and the second roller 73 so as to contact the first roller 72 and the second roller 73.

A medium 75 transported by the transport roller pair 31 is pinched between the first roller 72 and the third roller 74 and between the second roller 73 and the third roller 74. The first roller 72, the second roller 73, and the third roller 74 rotate to supply the medium 75 to the discharger 32. The medium 75 is curved by passing through along a roll surface of the third roller 74, and the bending tendency is corrected. In the same way as the above-described medium reversing and discharging device according to the first embodiment, the medium reversing and discharging device according to the first modification corrects the bending tendency of the medium 75 to prevent the medium 75 from buckling.

Medium Reversing and Discharging Device According to Second Modification

Figure 23:
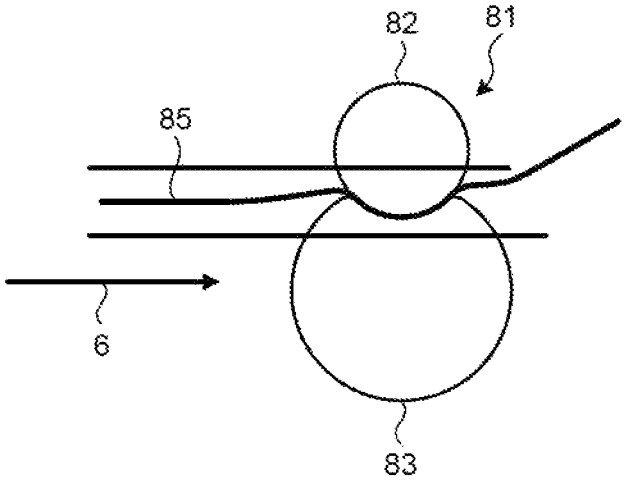
FIG. 23 is a side view illustrating a curving unit of a medium reversing and discharging device according to a second modification.

In a medium reversing and discharging device according to a second modification, as illustrated in FIG. 23, the curved portion 33 of the medium reversing and discharging device according to the first embodiment described above is replaced with another curving unit 81, and the other parts are the same as those of the medium reversing and discharging device according to the first embodiment described above. FIG. 23 is a side view illustrating the curving unit 81 of the medium reversing and discharging device according to the second modification. The curving unit 81 includes a first roller 82 and a second roller 83. The first roller 82 is cylindrical, and is disposed above the path connecting the transport roller pair 31 to the discharger 32. The second roller 83 is cylindrical, is formed of a material more flexible than that of the first roller 82, and has a diameter larger than that of the first roller 82. The second roller 83 is disposed to contact the first roller 82, and is elastically deformed by contacting with the first roller 82.

A medium 85 transported by the transport roller pair 31 is pinched between the first roller 82 and the second roller 83. The first roller 82 and the second roller 83 rotate to supply the medium 85 to the discharger 32. The medium 85 is curved by passing through along a roll surface of the first roller 82, and the bending tendency is corrected. In the same way as the above-described medium reversing and discharging device according to the first embodiment, the medium reversing and discharging device according to the second modification corrects the bending tendency of the medium 85 to prevent the medium 85 from buckling.

Although the above-described medium reversing and discharging device according to the first embodiment is provided with the curved portion 33 that curves the medium before the medium is discharged from the discharger 32, the curved portion 33 may be eliminated. Even when the curved portion 33 is eliminated, the medium reversing and discharging device can prevent the medium from buckling because when the holder 41 is disposed in the standby position, the paper discharge plane 62 does not intersect with the holding plane 63 on the downstream side in the paper discharge direction 35 of the discharge roller pair 36.

Second Embodiment

Figure 24:
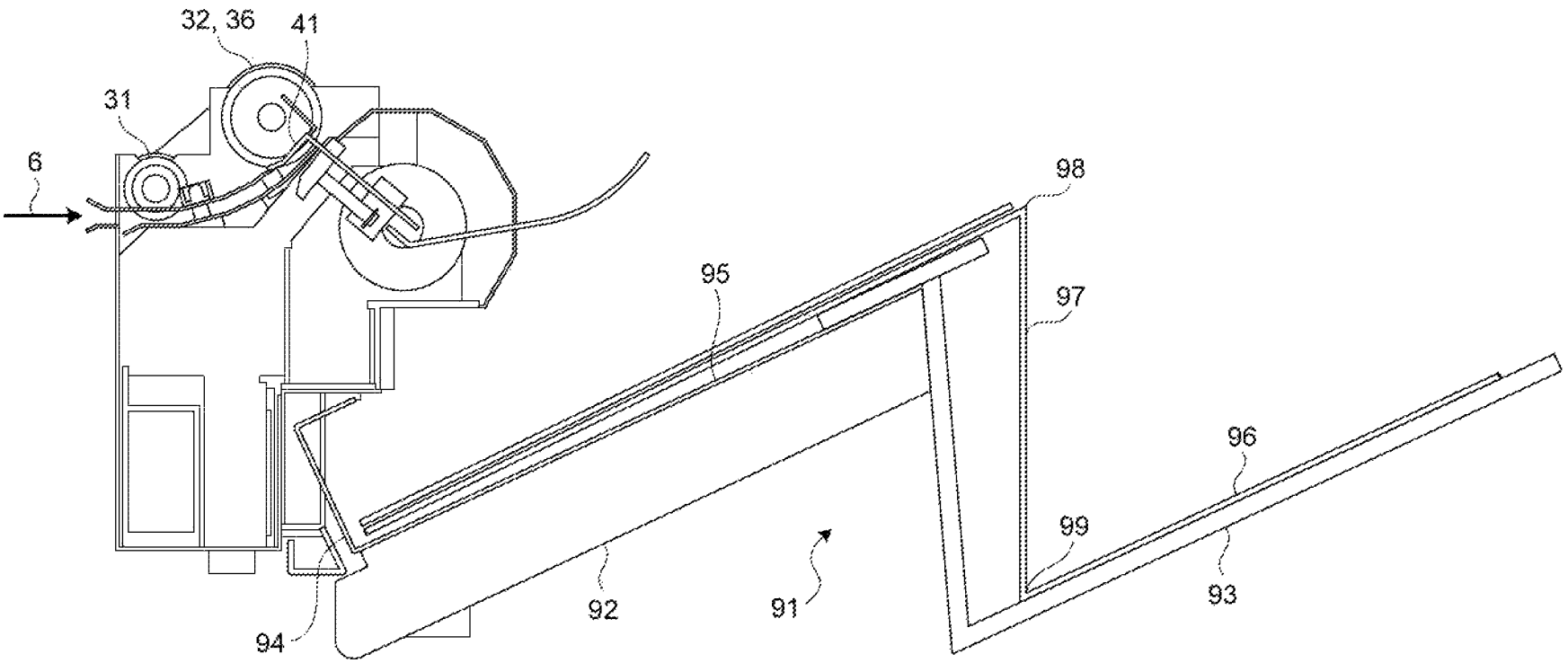
FIG. 24 is a side view illustrating an exit tray of a medium reversing and discharging device according to a second embodiment of the present disclosure.

In a medium reversing and discharging device according to a second embodiment of the present disclosure, as illustrated in FIG. 24, the exit tray 3 of the medium reversing and discharging device according to the first embodiment described above is replaced with another exit tray 91, and the other parts are the same as those of the medium reversing and discharging device according to the first embodiment described above. FIG. 24 is a side view illustrating the exit tray 91 of the medium reversing and discharging device according to the second embodiment. The exit tray 91 includes a first exit tray portion 92, a second exit tray portion 93, and a stopper 94. The first exit tray portion 92 is configured in the same way as the above-described exit tray body 25, and has a substantially flat first placement surface 95. The first exit tray portion 92 is fixed to the transport path 5 in an inclined state such that gravity moves the medium placed on the first placement surface 95 toward the upstream side in the transport direction 6. In addition, the first exit tray portion 92 is configured shorter than a length of the leading end to a first crease 98 of a z-folded medium 97.

The second exit tray portion 93 has a substantially flat second placement surface 96. The second exit tray portion 93 is disposed on the downstream in the transport direction 6 of the first exit tray portion 92. The second exit tray portion 93 is disposed such that a plane along the second placement surface 96 is substantially parallel to a plane along the first placement surface 95. Further, the second exit tray portion 93 is disposed such that the second placement surface 96 is disposed below the first placement surface 95 in the vertical direction. Further, the second exit tray portion 93 is fixed to the first exit tray portion 92 such that a distance between a distal end on the downstream side in the transport direction 6 of the first placement surface 95 and a proximate end on the upstream side in the transport direction 6 of the second placement surface 96 is smaller than a length of the first crease 98 to a second crease 99 of the Z-folded medium 97. The stopper 94 is configured in the same way as the above-described stopper 26, and has a substantially flat plate shape. The stopper 94 is disposed on the upstream side in the transport direction 6 of the first exit tray portion 92 such that a plane along the stopper 94 is orthogonal to a plane along the first placement surface 95, and is fixed to the first exit tray portion 92.

In the same way as the above-described medium reversing and discharging device according to the first embodiment, the medium reversing and discharging device according to the second embodiment reverses the medium and places it on the exit tray 91. That is, in the same way as the above-described medium reversing and discharging device according to the first embodiment, the medium reversing and discharging device according to the second embodiment can prevent the medium from buckling when reversing the medium. When the Z-folded medium 97 is reversed and placed on the exit tray 91 by the medium reversing and discharging device according to the second embodiment, a portion between the leading end and the first crease 98 is placed on the first exit tray portion 92, and a portion between the second crease 99 and the trailing end is placed on the second exit tray portion 93.

When the Z-folded medium 97 is reversed and placed on the flat placement surface, a folding tendency formed at the second crease 99 may cause the second crease 99 to return to the folded state and cause the Z-folded medium 97 to be placed on the placement surface in an inappropriately unfolded state. The medium reversing and discharging device according to the second embodiment can appropriately place the Z-folded medium 97 on the exit tray 91 in an unfolded state.

Third Embodiment

Figure 25:
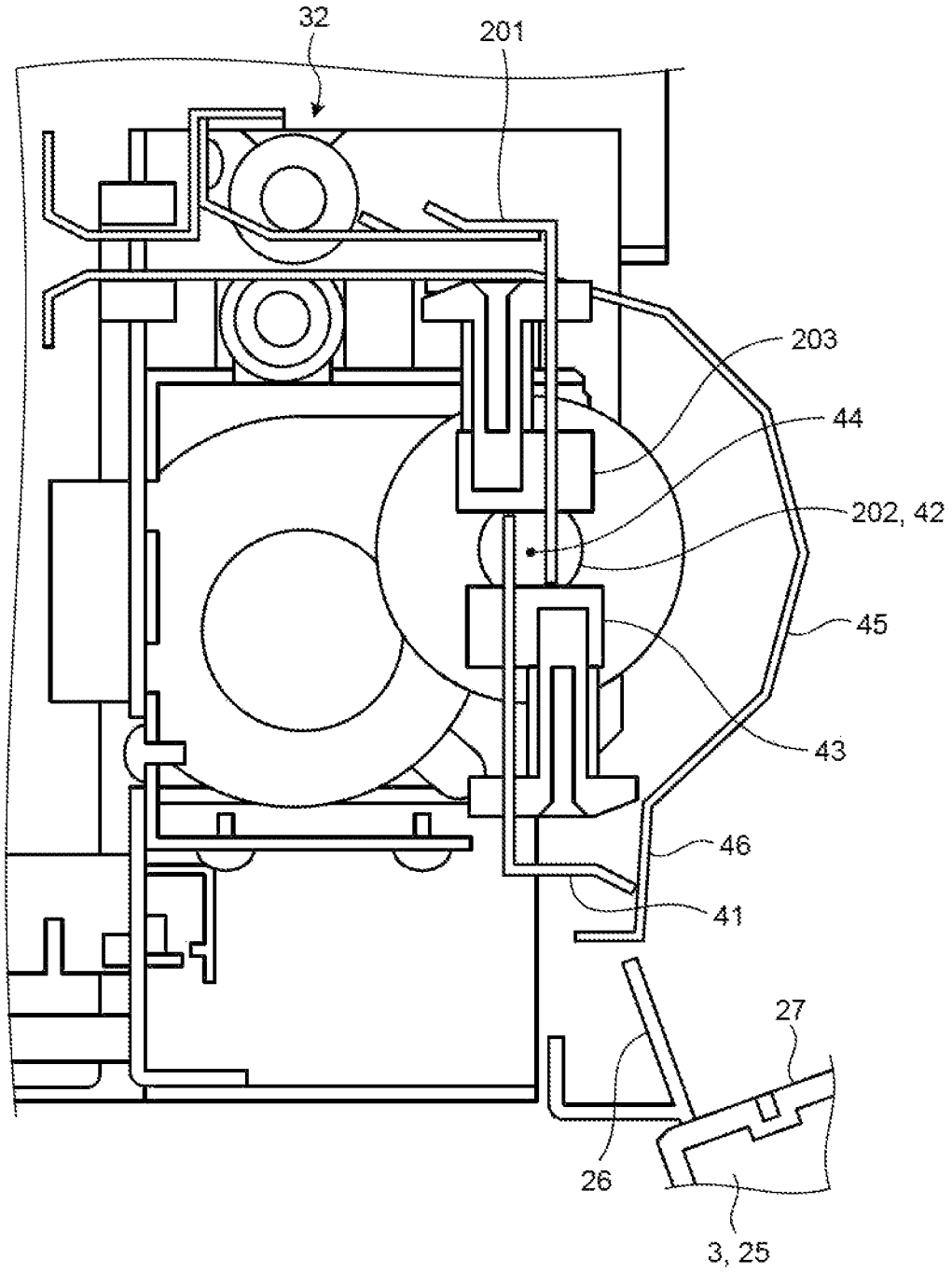
FIG. 25 is a side view illustrating the paper discharge unit of a medium reversing and discharging device according to a third embodiment of the present disclosure.

In a medium reversing and discharging device according to a third embodiment of the present disclosure, as illustrated in FIG. 25, another holder 201, another driver 202, and another cam mechanism 203 are added to the paper discharge unit 17 of the medium reversing and discharging device according to the first embodiment described above. FIG. 25 is a side view illustrating the paper discharge unit 17 of the medium reversing and discharging device according to the third embodiment. The holder 201 is configured in the same way as the above-described holder 41, and is switched to the holding mode or the releasing mode. The holder 201 holds the medium by being switched from the releasing mode to the holding mode, and releases the medium by being switched from the holding mode to the releasing mode. Further, the holder 201 is supported by the transport path 5 so as to be rotatable about the rotation axis 44 irrespective of the position of the holder 41. In the same way as the above-described driver 42, the driver 202 rotates the holder 201 about the rotation axis 44 to dispose the holder 201 in the initial position, the holding position, the standby position, and the hold releasing position. In the same way as the above-described cam mechanism 43, the cam mechanism 203 switches the holder 201 to the holding mode or the releasing mode corresponding to the position in which the holder 201 is disposed when the holder 201 rotates.

In the same way as the above-described medium reversing and discharging device according to the first embodiment, the medium reversing and discharging device according to the third embodiment can use the holder 201 to reverse the medium supplied from the discharger 32 and place the medium on the exit tray 3, and can prevent the medium from buckling. After the medium held by the holder 41 is discharged from the discharger 32, the medium reversing and discharging device according to the third embodiment can dispose the holder 201 in the initial position before the holder 41 is disposed in the initial position by controlling the driver. As a result, the medium reversing and discharging device according to the third embodiment can more quickly process a plurality of media than the above-described medium reversing and discharging device according to the first embodiment.

Fourth Embodiment

Figure 26:
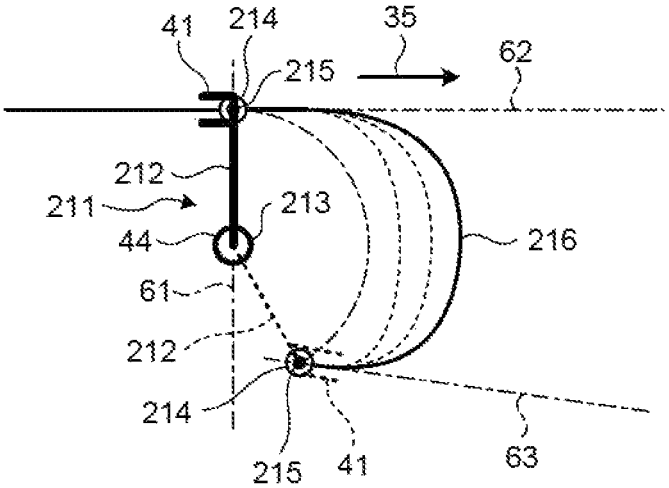
FIG. 26 is a side view illustrating a driver of a medium reversing and discharging device according to a fourth embodiment of the present disclosure.

In a medium reversing and discharging device according to a fourth embodiment of the present disclosure, as illustrated in FIG. 26, the driver 42 of the medium reversing and discharging device according to the first embodiment described above is replaced with another driver 211, and the other parts are the same as those of the medium reversing and discharging device according to the first embodiment described above. FIG. 26 is a side view illustrating the driver 211 of the medium reversing and discharging device according to the fourth embodiment. The driver 211 includes a movable body 212, a first driver 213, and a second driver 214. The movable body 212 is supported by the transport path 5 so as to be rotatable about the rotation axis 44. The first driver 213 rotates the movable body 212 about the rotation axis 44 with respect to the transport path 5. The second driver 214 rotates the holder 41 about a rotation axis 215 with respect to the movable body 212. The rotation axis 215 is parallel to the rotation axis 44, is fixed to the movable body 212, and rotates about the rotation axis 44 together with the movable body 212 while keeping a distance between the rotation axis 44 and the rotation axis 215 constant.

The first driver 213 rotates the movable body 212 about the rotation axis 44 to dispose the holder 41 in the initial position, the holding position, the standby position, and the hold releasing position. When the holder 41 is disposed in the standby position, the holder 41 is disposed on the downstream side in the paper discharge direction 35 of the plane 61 as indicated by a dashed line in FIG. 26, unlike in the case of the above-described medium reversing and discharging device according to the first embodiment. The second driver 214 rotates the holder 41 with respect to the movable body 212 such that the holding plane 63 overlaps the paper discharge plane 62 when the holder 41 is disposed in the initial position, and rotates the holder 41 with respect to the movable body 212 such that the holding plane 63 intersects with the paper discharge plane 62 on the upstream side in the paper discharge direction 35 of the plane 61 when the holder 41 is disposed in the standby position.

In the medium reversing and discharging device according to the fourth embodiment, in the same way as in the above-described medium reversing and discharging device according to the first embodiment, the holding plane 63 does not intersect with the paper discharge plane 62 on the downstream side in the paper discharge direction 35 of the plane 61 when the holder 41 is disposed in the standby position. As a result, A medium 216 can be prevented from buckling. In the medium reversing and discharging device according to the fourth embodiment, the angle of the rotation of the movable body 212 can be smaller than 180 degrees when the holder 41 moves from the initial position to the standby position. That is, in the medium reversing and discharging device according to the fourth embodiment, when the holder 41 moves from the initial position to the standby position, the angle of the rotation of the movable body 212 can be smaller than that in the above-described medium reversing and discharging device according to the first embodiment, allowing a reduction in scale of the device.

The above-described medium reversing and discharging device according to the first embodiment does not have a configuration corresponding to the second driver 214. Therefore, the above-described medium reversing and discharging device according to the first embodiment can be lower in manufacturing cost than the medium reversing and discharging device according to the fourth embodiment.

Fifth Embodiment

Figure 27:
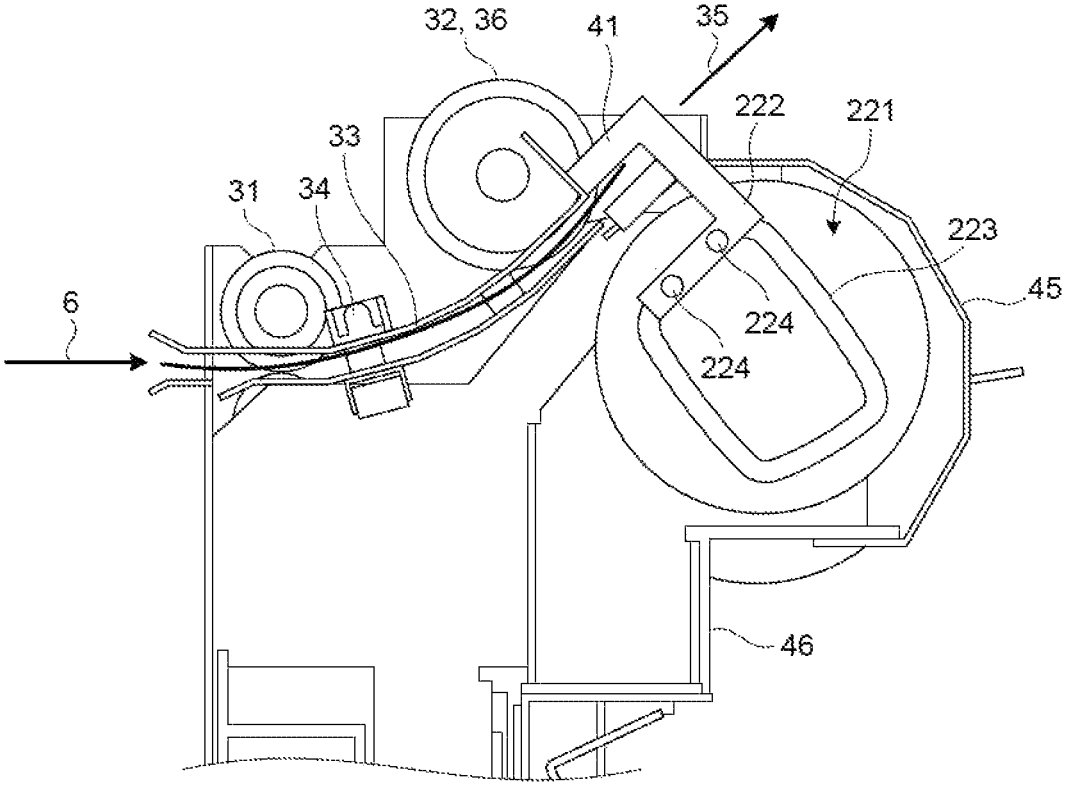
FIG. 27 is a side view illustrating a driver of a medium reversing and discharging device according to a fifth embodiment of the present disclosure.

In the medium reversing and discharging device according to each of the embodiments described above, the holder 41 rotates about the rotation axis 44 to be disposed in each of the positions. The holder 41 may, however, make a movement different from the rotation to be disposed in each of the positions. In a medium reversing and discharging device according to a fifth embodiment of the present disclosure, as illustrated in FIG. 27, the driver 42 of the medium reversing and discharging device according to the first embodiment described above is replaced with another driver, and the other parts are the same as those of the medium reversing and discharging device according to the first embodiment described above. FIG. 27 is a side view illustrating the driver 221 of the medium reversing and discharging device according to the fifth embodiment. The driver 221 includes a movable body 222 and a guide rail 223, and includes a driver body, which is not illustrated. The guide rail 223 is fixed with respect to the transport path 5. The holder 41 is fixed to the movable body 222. The movable body 222 has two guide pins 224. The two guide pins 224 are fitted in the guide rail 223. The guide rail 223 guides the two guide pins 224 to dispose the holder 41 in the initial position, the holding position, the standby position, and the hold releasing position. The driver body moves the movable body 222 to dispose the holder 41 in the initial position, the holding position, the standby position, and the hold releasing position.

Figure 28:
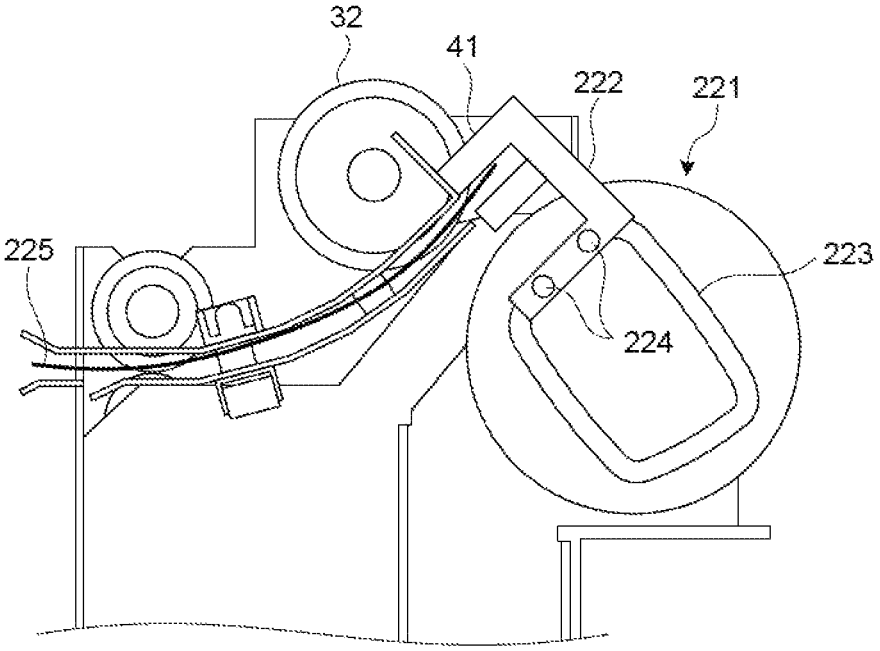
FIG. 28 is a side view illustrating the discharger of the medium reversing and discharging device according to the fifth embodiment when a medium has reached the holder.

The medium reversing and discharging device according to the fifth embodiment operates in the same way as the above-described medium reversing and discharging device according to the first embodiment. That is, when the holder 41 is disposed in the initial position, the medium reversing and discharging device according to the fifth embodiment waits until a medium 225 discharged from the discharger 32 reaches the holder 41 while keeping the holder 41 to be disposed in the initial position. FIG. 28 is a side view illustrating the discharger of the medium reversing and discharging device according to the fifth embodiment when the medium 225 has reached the holder 41. In the case where the holder 41 is disposed in the initial position, when the medium 225 has reached the holder 41, the medium reversing and discharging device according to the fifth embodiment moves the holder 41 from the initial position through the holding position to the standby position.

Figure 29:
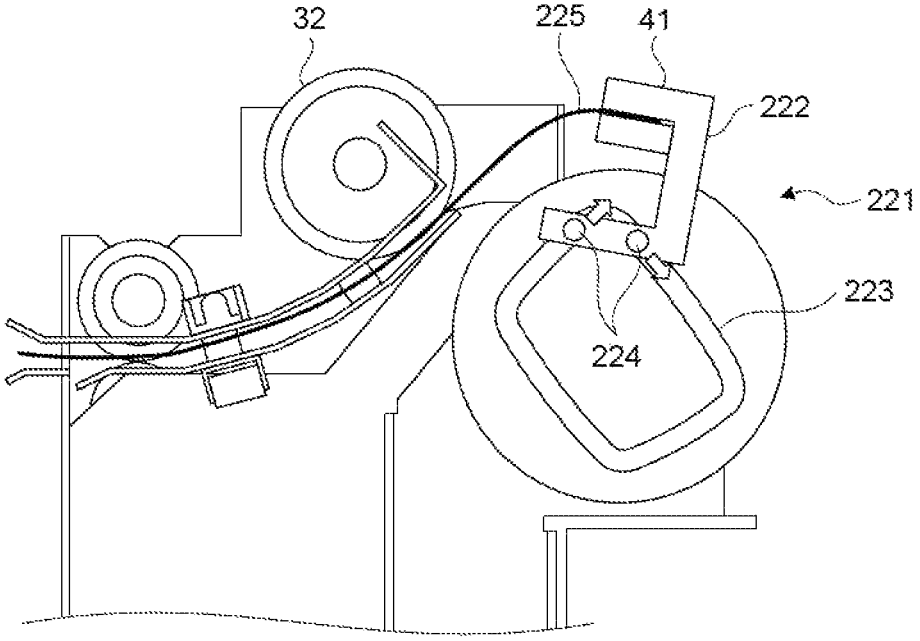
FIG. 29 is a side view illustrating the paper discharge unit of the medium reversing and discharging device according to the fifth embodiment while the holder is moving from a holding position to the standby position.

Since the holder 41 moves from the initial position to the holding position, the leading end of the medium 225 is held by the holder 41. FIG. 29 is a side view illustrating the paper discharge unit of the medium reversing and discharging device according to the fifth embodiment while the holder 41 is moving from the holding position to the standby position. After holding the leading end of the medium 225, the holder 41 moves to the standby position such that the moving speed at which the holder 41 moves is equal to the discharge speed at which the medium 225 is discharged from the discharger 32.

Figure 30:
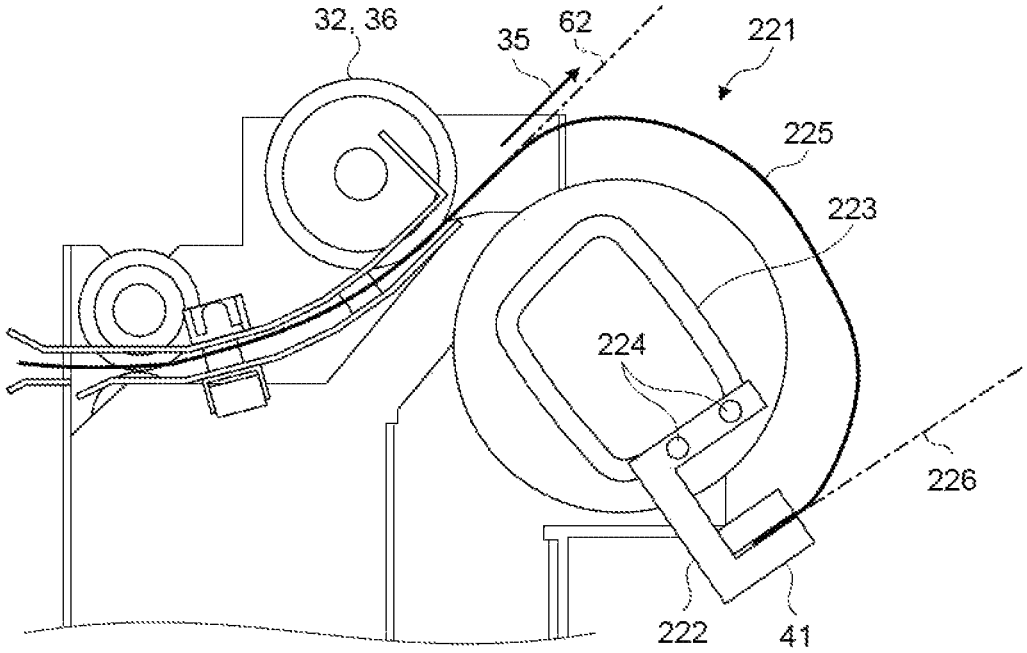
FIG. 30 is a side view illustrating the paper discharge unit of the medium reversing and discharging device according to the fifth embodiment when the holder is disposed in the standby position.
Figure 31:
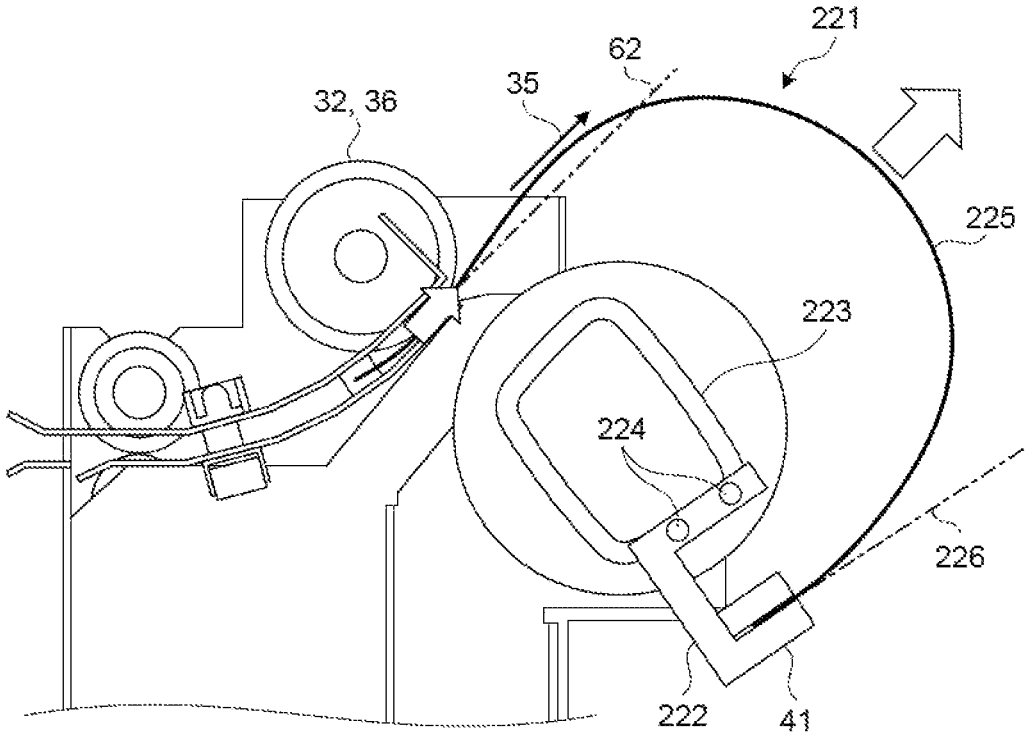
FIG. 31 is a side view illustrating the medium when the holder is stopped in the standby position in the medium reversing and discharging device according to the fifth embodiment.

FIG. 30 is a side view illustrating the paper discharge unit of the medium reversing and discharging device according to the fifth embodiment when the holder 41 is disposed in the standby position. When the holder 41 has reached the standby position, the medium reversing and discharging device according to the fifth embodiment continues to discharge the medium 225 from the discharger 32, and stops moving the holder 41 to dispose the holder 41 in the standby position. In the standby position, a holding plane 226 does not intersect with the paper discharge plane 62 on the downstream side in the paper discharge direction 35 of the discharge roller pair 36. Since the medium 225 is discharged from the discharger 32 while the holder 41 is disposed in the standby position, the medium 225 is deformed so as to expand toward the downstream side in the paper discharge direction 35, as illustrated in FIG. 31. FIG. 31 is a side view illustrating the medium 225 when the holder 41 is stopped in the standby position in the medium reversing and discharging device according to the fifth embodiment.

Figure 32:
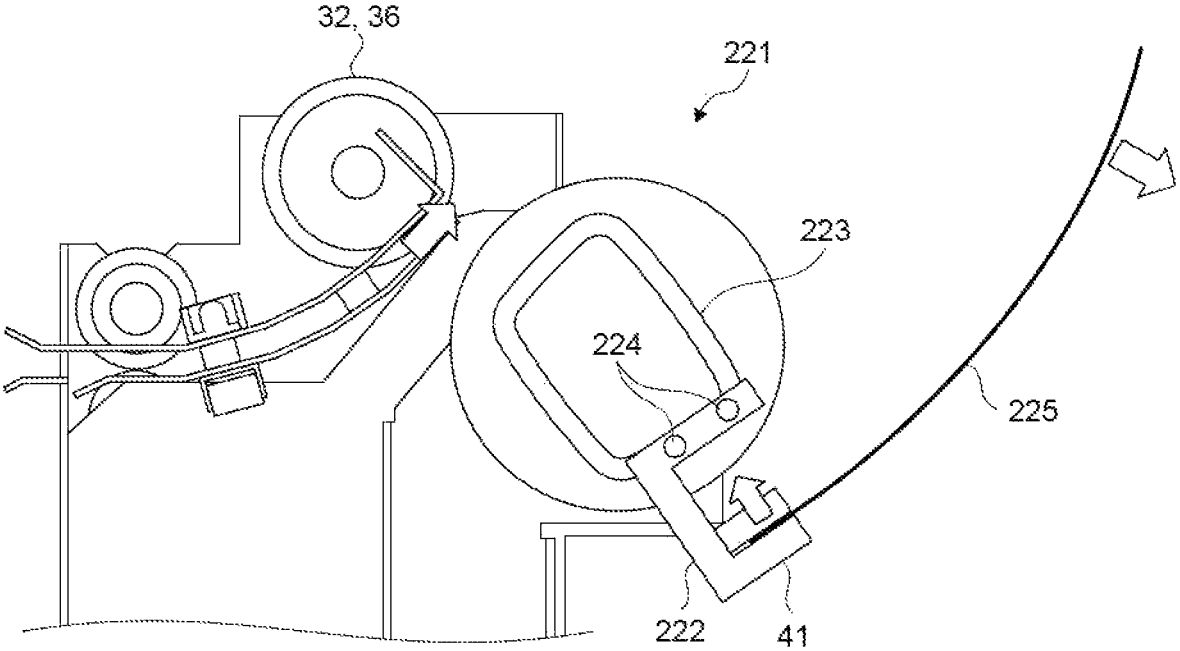
FIG. 32 is a side view illustrating the paper discharge unit of the medium reversing and discharging device according to the fifth embodiment when the trailing end of the medium has been released from the discharger.

The trailing end of the medium 225 is released from the discharger 32 after passing through the discharger 32. FIG. 32 is a side view illustrating the paper discharge unit of the medium reversing and discharging device according to the fifth embodiment when the trailing end of the medium 225 has been released from the discharger 32. After the trailing end of the medium 225 passes through the discharger 32, the medium reversing and discharging device according to the fifth embodiment moves the holder 41 from the standby position to the hold releasing position. Since the holder 41 moves from the standby position to the hold releasing position, the leading end of the medium 225 is released from the holder 41. The medium 225 falls and is placed on the exit tray 3 after the leading end thereof is released from the holder 41.

The medium reversing and discharging device according to the fifth embodiment is configured such that the holding plane 226 does not intersect with the paper discharge plane 62 on the downstream side in the paper discharge direction 35 of the discharge roller pair 36 when the holder 41 is disposed in the standby position. With this configuration, the medium reversing and discharging device according to the fifth embodiment can prevent the medium 225 from buckling, in the same way as the above-described medium reversing and discharging device according to the first embodiment.

Sixth Embodiment

Figure 33:
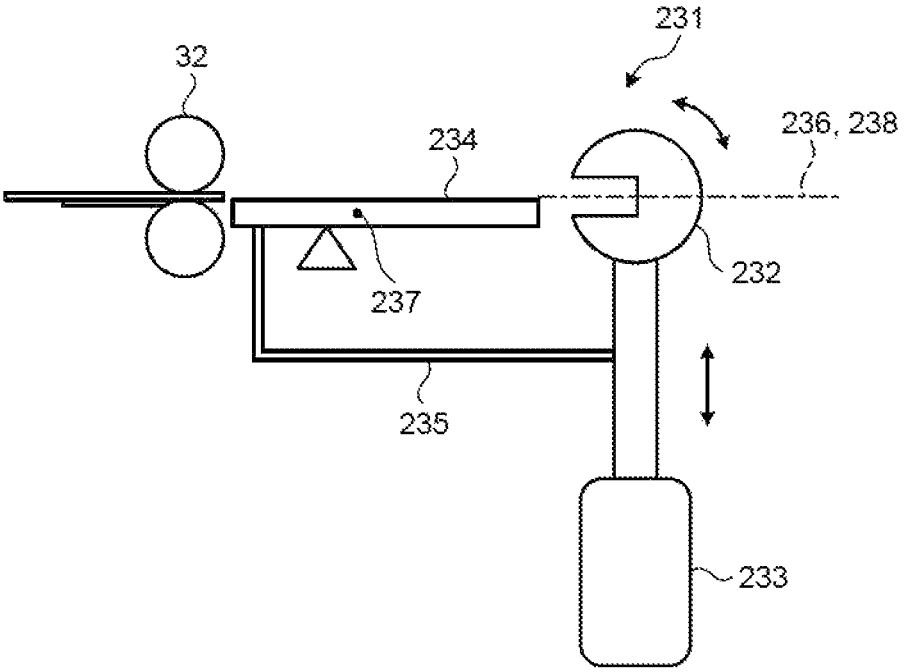
FIG. 33 is a schematic side view illustrating a paper discharge unit of a medium reversing and discharging device according to a sixth embodiment of the present disclosure.

Although the medium reversing and discharging device according to each of the embodiments described above discharges the medium so as not to move the paper discharge plane 62, the medium may be discharged so as to move the paper discharge plane 62. In a medium reversing and discharging device according to a sixth embodiment of the present disclosure, as illustrated in FIG. 33, the paper discharge unit 17 of the medium reversing and discharging device according to the first embodiment described above is replaced with another paper discharge unit 231, and the other parts are the same as those of the medium reversing and discharging device according to the first embodiment described above. FIG. 33 is a schematic side view illustrating the paper discharge unit 231 of the medium reversing and discharging device according to the sixth embodiment. In the paper discharge unit 231, the holder 41 and the driver 42 of the paper discharge unit 17 described above are replaced with another holder 232 and another driver 233, and a discharge outlet 234 and a discharge outlet driver 235 are added. The other parts are the same as those of the above-described paper discharge unit 17. The holder 232 is switched to the holding mode or the releasing mode. The holder 232 holds the medium by being switched from the releasing mode to the holding mode, and releases the medium by being switched from the holding mode to the releasing mode.

The driver 233 switches the holder 232 to the holding mode or the releasing mode. The driver 233 further moves the holder 232 up and down to dispose the holder 232 in the initial position and the standby position. The holder 232 is disposed near the discharge outlet 234 when the holder 232 is disposed in the initial position. The standby position is below the initial position. That is, the holder 232 is disposed in the standby position by moving down from the initial position, and is disposed in the initial position by moving up from the standby position. The driver 233 further rotates the holder 232 to rotate a holding plane 236. The holding plane 236 extends along a portion of the medium held by the holder 232.

The discharge outlet 234 has a plate shape. The discharge outlet 234 is disposed near the discharger 32 to contact the medium discharged from the discharger 32. The discharge outlet 234 is supported by the transport path 5 in a rotatable manner about a rotation axis 237 so as to be disposed in the initial position and the standby position. The rotation axis 237 is parallel to the plane along the installation surface of the image reading device 1, and is orthogonal to the transport direction 6.

The discharge outlet driver 235 rotates the discharge outlet 234 about the rotation axis 237 to rotate a paper discharge plane 238 as the driver 233 moves the holder 232 up and down. The paper discharge plane 238 extends along a portion of the medium discharged from the discharger 32 in contact with the discharge outlet 234 when the medium discharged from the discharger 32 contacts the discharge outlet 234. The discharge outlet driver 235 disposes the discharge outlet 234 in a position corresponding to the position of the holder 232.

Figure 34:
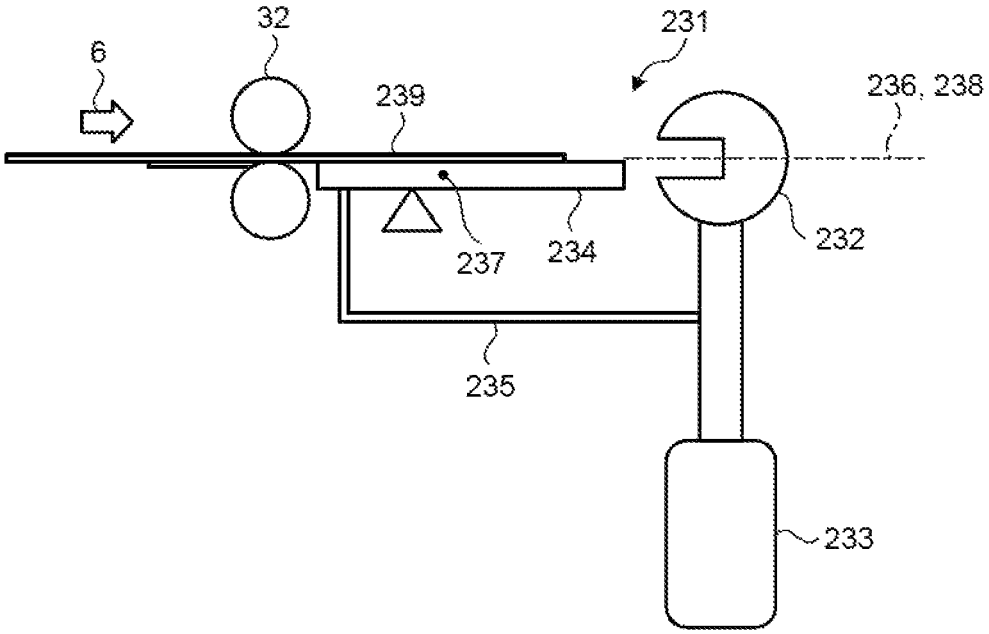
FIG. 34 is a schematic side view illustrating the paper discharge unit of the medium reversing and discharging device according to the sixth embodiment when a holder is disposed in an initial position.

Operation of Medium Reversing and Discharging Device According to Sixth Embodiment Before the medium is discharged from the discharger 32, the discharge outlet driver 235 rotates the discharge outlet 234 to dispose the discharge outlet 234 in an initial position. Disposing the discharge outlet 234 in the initial position causes the paper discharge plane 238 to overlap the discharger 32. Before the medium is discharged from the discharger 32, the driver 233 moves the holder 232 up or down to dispose the holder 232 in the initial position, and further, rotates the holder 232 so as to cause the holding plane 236 to overlap the paper discharge plane 238. FIG. 34 is a schematic side view illustrating the paper discharge unit 231 of the medium reversing and discharging device according to the sixth embodiment when the holder 232 is disposed in the initial position. A medium 239 discharged from the discharger 32 contacts the discharge outlet 234, is transported along the paper discharge plane 238, and is transported toward the holder 232.

Figure 35:
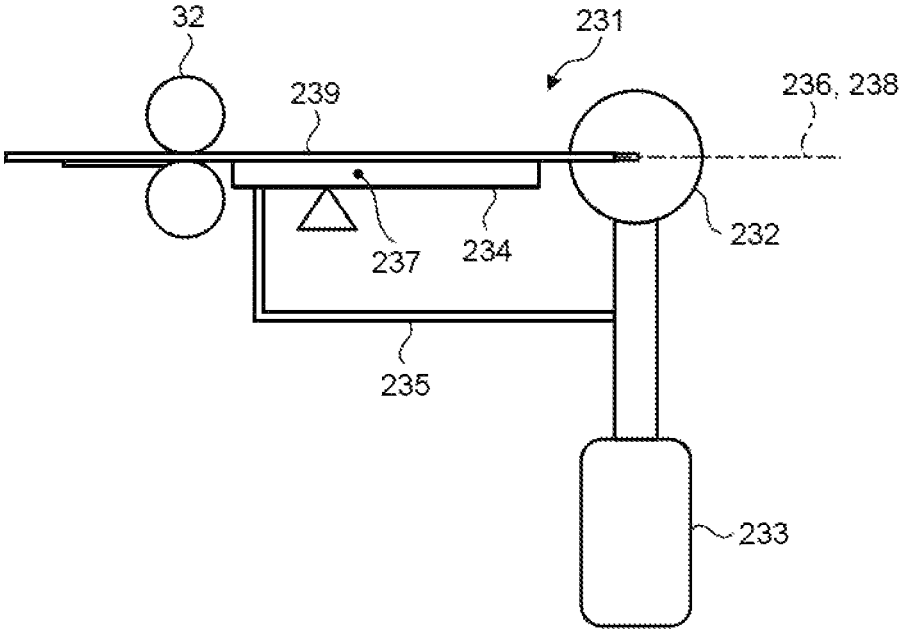
FIG. 35 is a schematic side view illustrating the paper discharge unit of the medium reversing and discharging device according to the sixth embodiment when a medium has reached the holder.

FIG. 35 is a schematic side view illustrating the paper discharge unit 231 of the medium reversing and discharging device according to the sixth embodiment when the medium 239 has reached the holder 232. After the medium 239 has reached the holder 232, the driver 233 switches the holder 232 to the holding mode. Since the holder 232 is switched to the holding mode, the leading end of the medium 239 is held by the holder 232.

Figure 36:
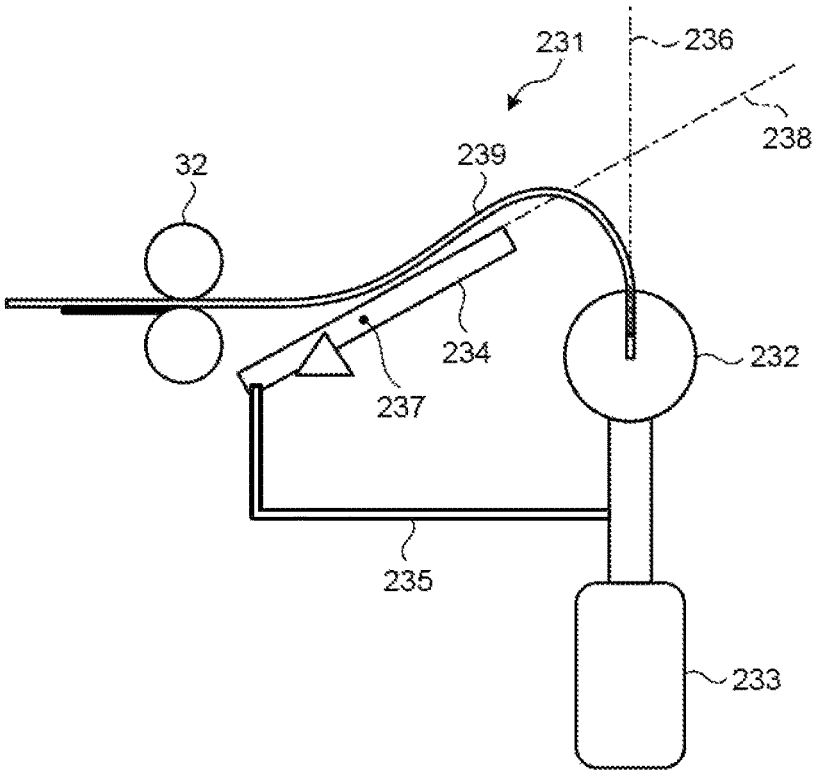
FIG. 36 is a schematic side view illustrating the paper discharge unit of the medium reversing and discharging device according to the sixth embodiment while the holder is moving from the holding position to the standby position.

As illustrated in FIG. 36, after the medium 239 is held by the holder 232, the driver 233 moves the holder 232 down toward the standby position, and rotates the holder 232 to rotate the holding plane 236. FIG. 36 is a schematic side view illustrating the paper discharge unit 231 of the medium reversing and discharging device according to the sixth embodiment while the holder 232 is moving from the holding position to the standby position. The discharge outlet driver 235 rotates the discharge outlet 234 about the rotation axis 237 toward a standby position to rotate the paper discharge plane 238 as the holder 232 moves down.

Figure 37:
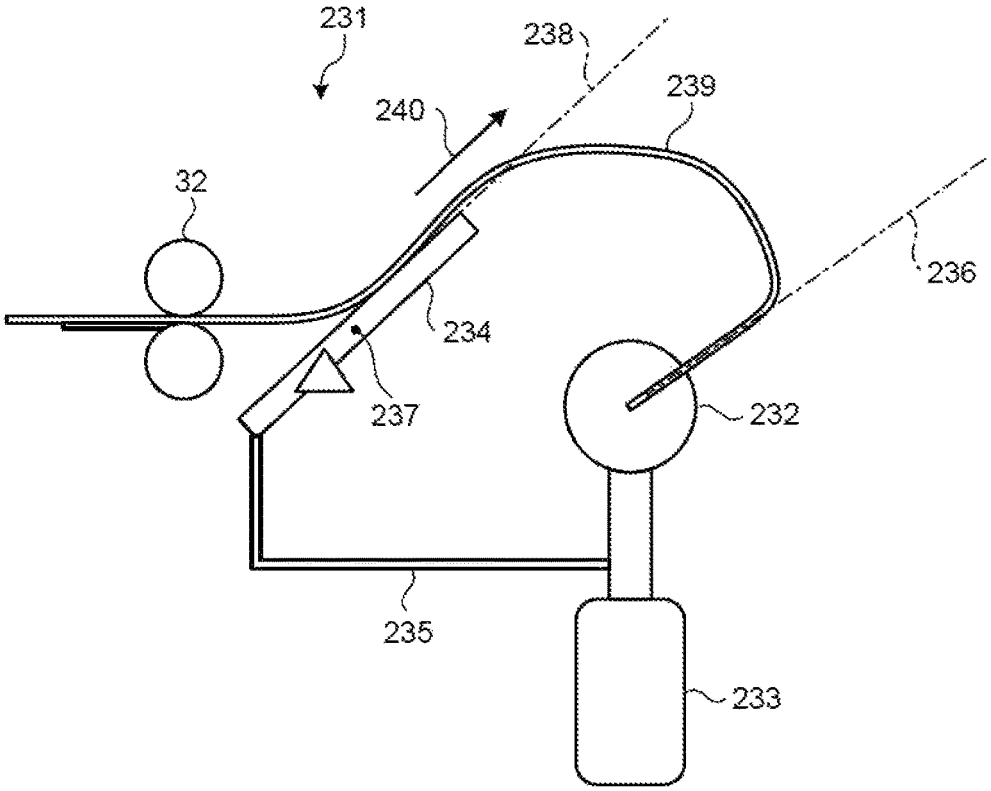
FIG. 37 is a schematic side view illustrating the paper discharge unit of the medium reversing and discharging device according to the sixth embodiment when the holder is disposed in the standby position.

FIG. 37 is a schematic side view illustrating the paper discharge unit 231 of the medium reversing and discharging device according to the sixth embodiment when the holder 232 is disposed in the standby position. When the holder 232 has reached the standby position, the driver 233 stops moving the holder 232 downward, and disposes the holder 232 in the standby position. The discharge outlet driver 235 stops rotating the discharge outlet 234 to dispose the discharge outlet 234 in a standby position as the driver 233 stops moving the holder 232 downward. At this time, since the discharge outlet 234 is disposed in the standby position, a portion of the medium 239 in contact with the discharge outlet 234 is discharged in a paper discharge direction 240 parallel to the paper discharge plane 238.

When the holder 232 and the discharge outlet 234 are each disposed in the standby position, the holding plane 236 intersects with the paper discharge plane 238 on the upstream side in the paper discharge direction 240 of the discharge outlet 234. That is, when the holder 232 and the discharge outlet 234 are disposed in the standby position, the holding plane 236 does not intersect with the paper discharge plane 238 on the downstream side in the paper discharge direction 240 of the discharge outlet 234. With this configuration, when the holder 232 and the discharge outlet 234 are each disposed in the standby position, the medium 239 is discharged from the discharger 32, and is thereby deformed so as to expand toward the paper discharge direction 240 without buckling.

Figure 38:
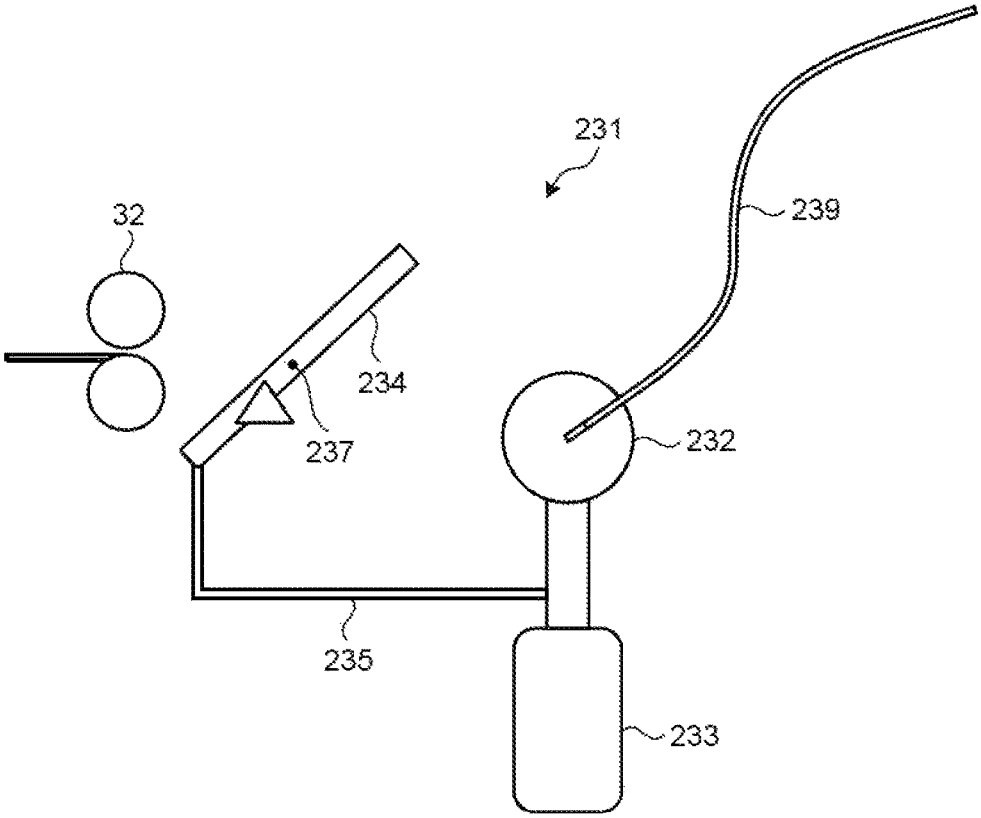
FIG. 38 is a schematic side view illustrating the paper discharge unit of the medium reversing and discharging device according to the sixth embodiment when the trailing end of the medium has been released from the discharger.
Figure 39:
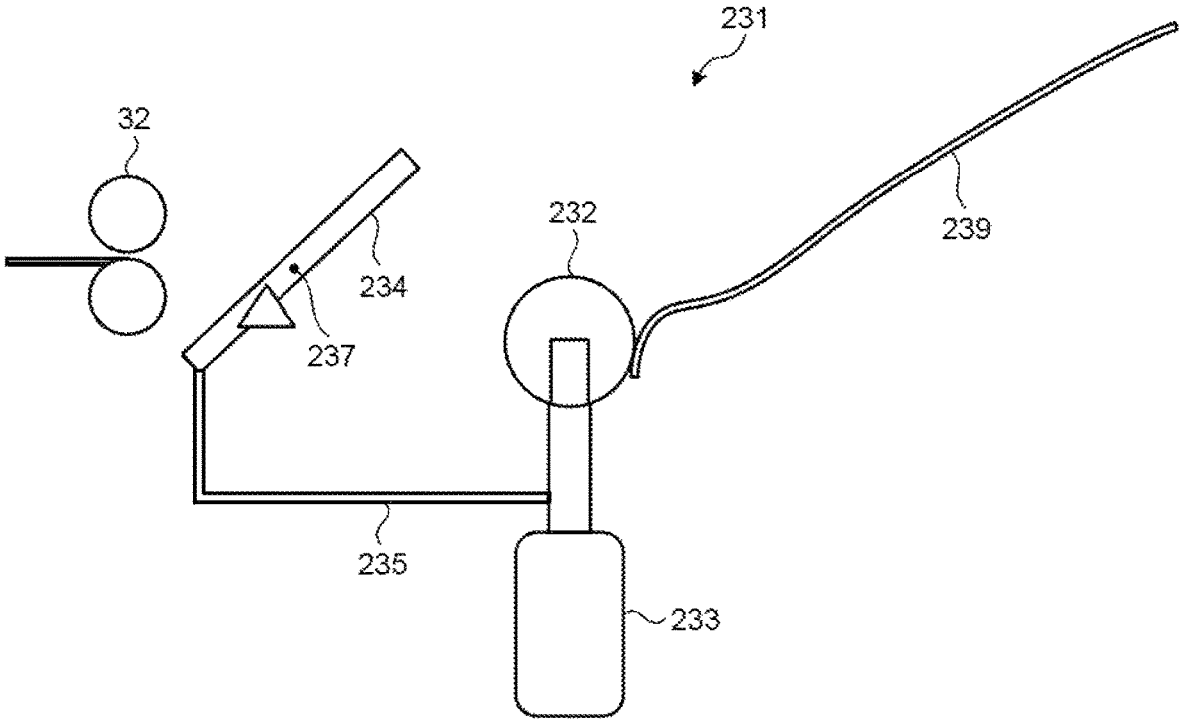
FIG. 39 is a schematic side view illustrating the paper discharge unit of the medium reversing and discharging device according to the sixth embodiment when the medium has been released from the holder.

The trailing end of the medium 239 is released from the discharger 32 after passing through the discharger 32. FIG. 38 is a schematic side view illustrating the paper discharge unit 231 of the medium reversing and discharging device according to the sixth embodiment when the trailing end of the medium 239 has been released from the discharger 32. After a predetermined period has elapsed from when the trailing end of the medium 239 has been released from the discharger 32, the driver 233 switches the holder 232 from the holding mode to the releasing mode to release the medium 239 from the holder 232, as illustrated in FIG. 39. FIG. 39 is a schematic side view illustrating the paper discharge unit 231 of the medium reversing and discharging device according to the sixth embodiment when the medium 239 has been released from the holder 232. The medium 239 falls and is placed on the exit tray 3 after being released from the holder 232.

In the medium reversing and discharging device according to the sixth embodiment, in the same way as in the above-described medium reversing and discharging device according to the first embodiment, the holding plane 236 does not intersect with the paper discharge plane 238 on the downstream side in the paper discharge direction 240 of the discharge outlet 234 when the holder 232 and the discharge outlet 234 are each disposed in the standby position. As a result, the medium can be prevented from buckling when the medium is reversed. The above-described medium reversing and discharging device according to the first embodiment does not have a configuration corresponding to the discharge outlet 234 and the discharge outlet driver 235. Therefore, the above-described medium reversing and discharging device according to the first embodiment can be lower in manufacturing cost than the medium reversing and discharging device according to the sixth embodiment.

Although the above-described medium reversing and discharging device of each of the first to sixth embodiments loosens the medium when the holder 41, 201, or 232 is stopped in the standby position, the medium may be loosened while the holder 41, 201, or 232 is moving in the standby position. In those cases, the medium reversing and discharging device moves the holder 41, 201, or 232 such that the moving speed at which the holder 41, 201, or 232 in the standby position is lower than the discharge speed at which the medium is discharged from the discharger 32. Even in such cases, the medium reversing and discharging device can appropriately loosen the medium, and can prevent the medium from buckling when the medium is reversed.

The medium reversing and discharging device according to each of the embodiments described above is used in the image reading device, but may be used in other devices. Examples of the devices include printers. For example, when the medium reversing and discharging device is used in a printer, the reading unit 18 is replaced with a printing device. Even when used in a device different from the image reading device, the medium reversing and discharging device can prevent the medium from buckling when the medium is reversed.

The disclosed medium reversing and discharging device can appropriately reverse the medium in the air.

All examples and conditional language recited herein are intended for pedagogical purposes of aiding the reader in understanding the disclosure and the concepts contributed by the inventor to further the art, and are not to be construed as limitations to such specifically recited examples and conditions, nor does the organization of such examples in the specification relate to a showing of the superiority and inferiority of the disclosure. Although the embodiments of the disclosure have been described in detail, it should be understood that the various changes, substitutions, and alterations could be made hereto without departing from the spirit and scope of the disclosure.

What is claimed is:

1. A medium reversing and discharging device comprising:

a discharger that discharges a medium in a first direction such that a portion of the medium in contact with the discharger is arranged along a first plane;

a holder that holds a leading end of the medium when the leading end of the medium is traveling along the first direction;

a driver that moves the holder to a standby position while the holder holds the leading end of the medium; and a stopper, wherein the leading end of the medium held by the holder is arranged along a second plane when the holder reaches the standby position, wherein the first plane and the second plane intersect each other upstream of the first direction with respect to the discharger, wherein a moving speed at which the holder moves at the standby position is lower than a discharge speed at which the medium is discharged in the first direction, and wherein after a trailing end of the medium is released from the discharger, the driver moves the holder from the standby position such that the leading end of the medium abuts on the stopper and comes off the holder.

2. The medium reversing and discharging device according to claim 1, further comprising an air blower that blows air onto the medium.

3. The medium reversing and discharging device according to claim 1, wherein the holder is supported so as to be rotatable about a rotation axis, and the driver that rotates the holder about the rotation axis such that a circumferential velocity of the holder is lower than the discharge speed while the holder is disposed on an upstream side in the first direction of a plane overlapping the rotation axis and the discharger.

4. The medium reversing and discharging device according to claim 1, wherein the holder is supported by a movable body being rotatably supported, and the driver comprises:

a first driver that moves the movable body; and a second driver that moves the holder with respect to the movable body.

5. The medium reversing and discharging device according to claim 1, wherein the discharger comprises a discharge outlet that is in contact with the medium discharged in the first direction, and a discharge outlet driver that moves the discharge outlet such that a portion of the medium in contact with the discharge outlet is arranged along the first plane.

6. The medium reversing and discharging device according to claim 1, further comprising a curved portion that curves the medium upward and downward before the medium is discharged in the first direction.

7. The medium reversing and discharging device according to claim 1, further comprising:

an exit tray on which the medium is placed after the medium is released from the holder; and an assist claw that moves together with the holder to contact the medium when the medium is placed on the exit tray, wherein the stopper faces the leading end of the medium when the medium is placed on the exit tray.

8. The medium reversing and discharging device according to claim 7, wherein the exit tray comprises:

a first exit tray portion that has a first placement surface on which a leading end portion of the medium is placed; and a second exit tray portion that has a second placement surface on which another portion different from the leading end portion of the medium is placed, and wherein the second placement surface is disposed below the first placement surface in a vertical direction of the first placement surface.

9. The medium reversing and discharging device according to claim 1, further comprising:

another holder that holds a leading end of another medium different from the medium when the leading end of the another medium is traveling along the first direction; and another driver that moves the another holder to the standby position while the another holder holds the leading end of the another medium, wherein the leading end of the another medium held by the another holder is arranged along the second plane when the another holder reaches the standby position.

10. The medium reversing and discharging device according to claim 1, wherein the discharger is formed such that the first direction is inclined obliquely upward.

* * * * *